US008131541B2

(12) United States Patent
Yen et al.

(10) Patent No.: US 8,131,541 B2
(45) Date of Patent: Mar. 6, 2012

(54) TWO MICROPHONE NOISE REDUCTION SYSTEM

(75) Inventors: Kuan-Chieh Yen, Northville, MI (US); Rogerio Guedes Alves, Macomb Township, MI (US)

(73) Assignee: Cambridge Silicon Radio Limited (GB)

( * ) Notice: Subject to any disclaimer, the term of this patent is extended or adjusted under 35 U.S.C. 154(b) by 985 days.

(21) Appl. No.: 12/110,182

(22) Filed: Apr. 25, 2008

(65) Prior Publication Data

US 2009/0271187 A1 Oct. 29, 2009

(51) Int. Cl.
*G10L 19/00* (2006.01)

(52) U.S. Cl. ..... 704/216; 704/217; 704/218; 704/226; 704/200

(58) Field of Classification Search ..... 704/216, 704/217, 218, 226, 200
See application file for complete search history.

(56) References Cited

U.S. PATENT DOCUMENTS

| | | | | |
|---|---|---|---|---|
| 5,539,832 | A | 7/1996 | Weinstein | |
| 5,774,561 | A * | 6/1998 | Nakagawa et al. | 381/66 |
| 6,625,587 | B1 | 9/2003 | Erten | |
| 6,691,073 | B1 | 2/2004 | Erten | |
| 6,898,612 | B1 | 5/2005 | Parra | |
| 7,146,316 | B2 | 12/2006 | Alves | |
| 7,319,954 | B2 * | 1/2008 | Deligne et al. | 704/224 |
| 2006/0034447 | A1 | 2/2006 | Alves | |

OTHER PUBLICATIONS

Huang et al., "Subband-based Adaptive Decorrelation Filtering for Co-channel Speech Separation", IEEE, Transactions on speech land audio processing, vol. 8, No. 4, Jul. 2000.*
Hu et al.,"Fast noise compensation for speech separation in diffuse noise", IEEE, ICASSP, 2006.*
Hu et al., "Fast noise compensation and adaptive enhancement for speech separation", EURASIP Journal on Audio, Speech, and Music Processing, vol. 2008, Janury 2008.*
S. F. Boll, "Suppression of acoustic noise in speech using spectral subtraction," IEEE Transactions in Acoustic, Speed, Signal Processing, vol. 27, pp. 113-120, Apr. 1979.
Y. Ephraim and H. L. Van Trees, "A signal subspace approach for speech enhancement," IEEE Transactions on Speech and Audio Processing, vol. 3, pp. 251-266, 1995.
J. Huang and Y. Zhao, "An energy-constrained signal subspace method for speech enhancement and recognition in white and colored noises," Speech Communications, vol. 26, pp. 165-181, 1998.
N. Virag, "Single channel speech enhancement based on masking properties of the human auditory system," IEEE Transactions on Speech and Audio Processing, vol. 7, No. 2, Mar. 1999.
B. D. Van Veen and K. M. Buckley, "Beamforming: a versatile approach to spatial filtering," IEEE ASSP Magazine, pp. 4-24, Apr. 1988.
Y. Kaneda and J. Ohga, "Adaptive microphone-array system for noise reduction," IEEE Transactions on Acoustic, Speech, and Signal Processing, vol. 34, pp. 1391-1400, 1986.

(Continued)

*Primary Examiner* — Qi Han
(74) *Attorney, Agent, or Firm* — Gary R. Jarosik

(57) ABSTRACT

A two microphone noise reduction system is described. In an embodiment, input signals from each of the microphones are divided into subbands and each subband is then filtered independently to separate noise and desired signals and to suppress non-stationary and stationary noise. Filtering methods used include adaptive decorrelation filtering. A post-processing module using adaptive noise cancellation like filtering algorithms may be used to further suppress stationary and non-stationary noise in the output signals from the adaptive decorrelation filtering and a single microphone noise reduction algorithm may be used to further provide optimal stationary noise reduction performance of the system.

15 Claims, 17 Drawing Sheets

OTHER PUBLICATIONS

E. Weinstein, M. Feder and A. V. Oppenheim, "Multi-channel signal separation by decorrelation," IEEE Transactions on Speech and Audio Processing, vol. 1, No. 4, pp. 405-413, Oct. 1993.
S. Van Gerven and D. Van Compernolle, "Signal separation by symmetric adaptive decorrelation: stability, convergence, and uniqueness," IEEE Transactions on Signal Processing, vol. 43, No. 7, pp. 1602-1612, Jul. 1997.
J. K. Tugnait, "Identification and deconvolution of multichannel linear non-gaussian processes using higher order statistics and inverse filter criteria," IEEE Transactions on Signal Processing, vol. 45, pp. 658-672 Mar. 1997.
B. Papadias, "Kurtosis-based criteria for adaptive blind source separation," in Proceedings of the ICASSP, 1998, vol. 4, pp. 2417-2320.
M. Kawamoto, A. K. Barros, A. Mansour, K. Matsuoka, and N. Ohmishi, "Real world blind separation of convolved non-stationary signals," in Proc. ICA'99, pp. 347-352, Jan. 1999.
K. Yen and Y. Zhao, "Adaptive Co-channel speech separation and recognition," IEEE Transactions on Speech and Audio Processing, vol. 7, No. 2, pp. 138-151, Mar. 1999.
K. Yen, "Co-channel speech separation based on adaptive decorrelation filtering," Ph.D. Dissertation, University of Illinois at Urbana-Champaign, 2001.
S. Araki, S. Makino, R. Aichner, T. Nishikawa, and H. Saruwatari, "Subband-based blind separation for convolutive mixtures of speech, " IEICE Trans. Fundamentals, vol. E88-A, No. 12, pp. 3593-3603, Dec. 2005.
R. Mukai, S. Araki, H. Sawada, and S. Makino, "Removal of residual crosstalk components in blind source separation using LMS filters," in Proc. IEEE Workshop Neural Networks Signal Processing, Sep. 2002, pp. 435-444.
S. Y. Low, S. Nordholm, R. Togneri, "Convolutive blind signal separation with post-processing," IEEE Transactions on Speech and Audio Processing, vol. 12, No. 5, Sep. 2004.
H. Robbins and S. Monro, "A Stochastic Approximation Method," Annals of Mathematical Statistics, vol. 22, pp. 400-407, 1951.
B. Widrow and S. D. Stearns, Adaptive Signal Processing, Prentice-Hall, 1985.
B. Widrow, J. R. Glover, Jr., J. M. McCool, J. Kaunitz, C. S. Williams, R. H. Hearn, J. R. Zeidler, E. Dong, Jr., and R.C. Goodlin,, "Adaptive noise cancelling: principles and application," in Proc. IEEE, vol. 63, pp. 1692-1716, 1975.
J. E. Greenberg, "Modified LMS algorithms for speech processing with an adaptive noise canceller," IEEE Transactions on Speech and Audio Processing, vol. 6, No. 4, Jul. 1998.
P. S. R. Diniz, Adaptive Filtering—Algorithms and Practical Implementation. Second Edition, Kluwer Academic Publishers, 2002.
M. R. Petraglia, R. G. Alves, P. S. R. Diniz, "Convergence analysis of an oversampled subband adaptive filtering structure with local errors", ISCAS—IEEE International Symposium on Circuits and Systems, May, 2000.

* cited by examiner

TWO MICROPHONE NOISE REDUCTION SYSTEM

FIELD OF THE INVENTION

This invention relates generally to voice communication systems and, more specifically, to microphone noise reduction systems to suppress noise and provide optimal audio quality.

BACKGROUND OF THE INVENTION

Voice communications systems have traditionally used single-microphone noise reduction (NR) algorithms to suppress noise and provide optimal audio quality. Such algorithms, which depend on statistical differences between speech and noise, provide effective suppression of stationary noise, particularly where the signal to noise ratio (SNR) is moderate to high. However, the algorithms are less effective where the SNR is very low.

Mobile devices, such as cellular telephones, are used in many diverse environments, such as train stations, airports, busy streets and bars. Traditional single-microphone NR algorithms do not work effectively in these environments where the noise is dynamic (or non-stationary), e.g., background speech, music, passing vehicles etc. In order to suppress dynamic noise and further optimize NR performance on stationary noise, multiple-microphone NR algorithms have been proposed to address the problem using spatial information. However, these are typically computationally intensive and therefore are not suited to use in embedded devices, where processing power and battery life are constrained.

Further challenges to noise reduction are introduced by the reducing size of devices, such as cellular telephones and Bluetooth® headsets. This reduction in size of a device generally increases the distance between the microphone and the mouth of the user and results in lower user speech power at the microphone (and therefore lower SNR).

BRIEF DESCRIPTION OF THE DRAWINGS

Preferred and alternative examples of the present invention are described in detail below with reference to the following drawings.

Figure 1:
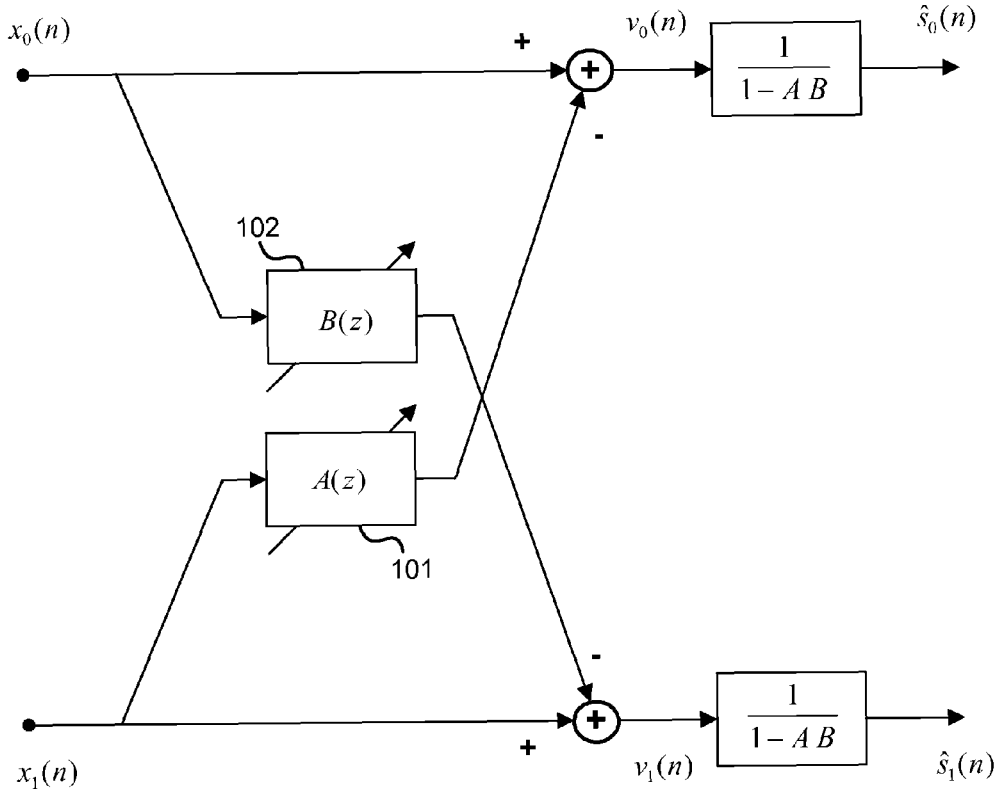
FIG. 1 PRIOR ART
FIG. 1 shows a block diagram of an adaptive decorrelation filtering (ADF) signal separation system.

Common reference numerals are used throughout the Figures to indicate similar features.

DETAILED DESCRIPTION OF THE PREFERRED EMBODIMENT

A two microphone noise reduction system is described. In an embodiment, input signals from each of the microphones are divided into subbands and each subband is then filtered independently to separate noise and desired signals and to suppress non-stationary and stationary noise. Filtering methods used include adaptive decorrelation filtering. A post-processing module using adaptive noise cancellation like filtering algorithms may be used to further suppress stationary and non-stationary noise in the output signals from the adaptive decorrelation filtering and a single microphone noise reduction algorithm may be used to further optimize the stationary noise reduction performance of the system.

A first aspect provides a method of noise reduction comprising: decomposing each of a first and a second input signal into a plurality of subbands, the first and second input signals being received by two closely spaced microphones; applying at least one filter independently in each subband to generate a plurality of filtered subband signals from the first input signal, wherein said at least one filter comprises an adaptive decorrelation filter; and combining said plurality of filtered subband signals from the first input signal to generate a restored fullband signal.

The step of applying at least one filter independently in each subband to generate a plurality of filtered subband signals from the first input signal may comprise: applying an adaptive decorrelation filter in each subband for each of the first and second signals to generate a plurality of filtered subband signals from each of the first and second input signals; and adapting the filter in each subband for each of the input signals based on a step-size function associated with the subband and the input signal.

The step-size function associated with a subband and an input signal may be normalized against a total power in the subband for both the first and second input signals.

The direction of the step-size function associated with a subband and one of the first and second input signals may be adjusted according to a phase of a cross-correlation between an input subband signal from the other of the first and second input signals and a filtered subband signal from said other of the first and second input signals.

The step-size function associated with a subband and an input signal may be adjusted based on a ratio of a power level of the filtered subband signal from said subband input signal to a power level of said subband input signal.

The step of applying at least one filter independently in each subband to generate a plurality of filtered subband signals from the first input signal may comprise: applying an adaptive decorrelation filter independently in each subband to generate a plurality of separated subband signals from each of the first and second input signals; and applying an adaptive noise cancellation filter to the separated subband signals independently in each subband to generate a plurality of filtered subband signals from the first input signal.

The step of applying an adaptive noise cancellation filter to the separated subband signals independently in each subband may comprise: applying an adaptive noise cancellation filter independently to a first and a second separated subband signal in each subband; and adapting each said adaptive noise cancellation filter in each subband based on a step-size function associated with the separated subband signal.

The method may further comprise, for each separated subband signal: if a subband is in a defined frequency range, setting the associated step-size function to zero if power in the separated subband signal exceeds power in a corresponding filtered subband signal; and if a subband is not in the defined frequency range, setting the associated step-size function to zero based on a determination of a number of subbands in the defined frequency range having an associated step-size set to zero.

The step of applying at least one filter independently in each subband to generate a plurality of filtered subband signals from the first input signal may comprise: applying an adaptive decorrelation filter independently in each subband to generate a plurality of separated subband signals from each of the first and second input signals; applying an adaptive noise cancellation filter to the separated subband signals independently in each subband to generate a plurality of error subband signals from the first input signal; and applying a single-microphone noise reduction algorithm to the error subband signals to generate a plurality of filtered subband signals from the first input signal.

A second aspect provides a noise reduction system comprising: a first input from a first microphone; a second input from a second microphone closely spaced from the first microphone; an analysis filter bank coupled to the first input and arranged to decompose a first input signal into subbands; an analysis filter bank coupled to the second input and arranged to decompose a second input signal into subbands; at least one adaptive filter element arranged to be applied independently in each subband, the at least one adaptive filter element comprising an adaptive decorrelation filter element; and a synthesis filter bank arranged to combine a plurality of restored subband signals output from the at least one adaptive filter element.

The adaptive decorrelation filter element may be arranged to control adaptation of the filter element for each subband based on power levels of a first input subband signal and a second input subband signal.

The adaptive decorrelation filter element may be further arranged to control a direction of adaptation of the filter element for each subband for a first input based on a phase of a cross correlation of a second input subband signal and a second subband signal output from the adaptive decorrelation filter element.

The adaptive decorrelation filter element may be further arranged to control adaptation of the filter element for each subband for the first input based on a ratio of a power level of a first subband signal output from the adaptive decorrelation filter element to a power level of a first subband input signal.

The at least one adaptive filter element may further comprise an adaptive noise cancellation filter element.

The adaptive noise cancellation filter element may be arranged to: stop adaptation of the adaptive noise cancellation filter element for subbands in a defined frequency range where the subband power input to the adaptive noise cancellation filter element exceeds the subband power output from the adaptive noise cancellation filter element; and to stop adaptation of the adaptive noise cancellation filter element for subbands not in the defined frequency range based on an assessment of adaptation rates in subbands in the defined frequency range.

The at least one adaptive filter element may further comprise a single-microphone noise reduction element.

A third aspect provides a method of noise reduction comprising: receiving a first signal from a first microphone; receiving a second signal from a second microphone; decomposing the first and second signals into a plurality of subbands; and for each subband, applying an adaptive decorrelation filter independently.

The step of applying an adaptive decorrelation filter independently may comprise, for each adaptation step m: computing samples of separated signals $v_{0,k}(m)$ and $v_{1,k}(m)$ corresponding to the first and second signals in a subband k based on estimates of filters of length M with coefficients $\bar{a}_k$ and $\bar{b}_k$, using:

$$v_{0,k}(m)=x_{0,k}(m)-\bar{x}_{1,k}(m)^T\bar{a}_k^{(m-1)}$$

$$v_{1,k}(m)=x_{1,k}(m)-\bar{x}_{0,k}(m)^T\bar{b}_k^{(m-1)} \quad (1)$$

where:

$$\bar{x}_{0,k}(m)=[x_{0,k}(m)x_{0,k}(m-1)\ldots x_{0,k}(m-M+1)]^T$$

$$\bar{x}_{1,k}(m)=[x_{1,k}(m)x_{1,k}(m-1)\ldots x_{1,k}(m-M+1)]^T$$

$$\bar{a}_k=[a_k(0)a_k(1)\ldots a_k(M-1)]^T$$

$$\bar{b}_k=[b_k(0)b_k(1)\ldots b_k(M-1)]^T$$

and; updating the filter coefficients, using:

$$\bar{a}_k^{(m)}=\bar{a}_k^{(m-1)}+\mu_{a,k}(m)\bar{v}_{1,k}^*(m)v_{0,k}(m)$$

$$\bar{b}_k^{(m)}=\bar{b}_k^{(m-1)}+\mu_{b,k}(m)\bar{v}_{0,k}^*(m)v_{1,k}(m) \quad (2)$$

where * denotes a complex conjugate, $\mu_{a,k}(m)$ and $\mu_{b,k}(m)$ are subband step-size functions and where:

$$\bar{v}_{0,k}(m)[v_{0,k}(m)v_{0,k}(m-1)\ldots v_{0,k}(m-M+1)]^T$$

$$\bar{v}_{1,k}(m)[v_{1,k}(m)v_{1,k}(m-1)\ldots v_{1,k}(m-M+1)]^T$$

The subband step-size functions may be given by:

$$\mu_{a,k}=\frac{2\gamma\exp(-j\angle\sigma_{x1v1,k})}{M(\sigma_{x0,k}^2+\sigma_{x1,k}^2)}\times\max\left(1-\frac{\sigma_{\hat{s}0,k}^2}{\sigma_{x0,k}^2},0\right) \quad (3)$$

and:

$$\mu_{b,k}=\frac{2\gamma\exp(-j\angle\sigma_{x0v0,k})}{M(\sigma_{x0,k}^2+\sigma_{x1,k}^2)}\times\max\left(1-\frac{\sigma_{\hat{s}1,k}^2}{\sigma_{x1,k}^2},0\right) \quad (4)$$

where:

$$\sigma_{\hat{s}0,k}^2=E\{|\hat{s}_{0,k}(m)|^2\}$$

$$\sigma_{\hat{s}1,k}^2=E\{|\hat{s}_{1,k}(m)|^2\}$$

$$\sigma_{x0,k}^2=E\{|x_{0,k}(m)|^2\}$$

$$\sigma_{x1,k}^2=E\{|x_{1,k}(m)|^2\}$$

$$\sigma_{x0v0,k}=E\{x_{0,k}(m)v_{0,k}^*(m)\}$$

$$\sigma_{x1v1,k}=E\{x_{1,k}(m)v_{1,k}^*(m)\};\text{ and}$$

where $\hat{s}_{0,k}(m)$ and $\hat{s}_{1,k}(m)$ comprise restored subband signals.

The method may further comprise, for each subband, applying an adaptive noise cancellation filter independently to signals output from the adaptive decorrelation filter.

The methods described herein may be performed by firmware or software in machine readable form on a storage medium. The software can be suitable for execution on a parallel processor or a serial processor such that the method steps may be carried out in any suitable order, or simultaneously.

A fourth aspect provides one or more tangible computer readable media comprising executable instructions for performing steps of any of the methods described herein.

This acknowledges that firmware and software can be valuable, separately tradable commodities. It is intended to encompass software, which runs on or controls "dumb" or standard hardware, to carry out the desired functions. It is also intended to encompass software which "describes" or defines the configuration of hardware, such as HDL (hardware description language) software, as is used for designing silicon chips, or for configuring universal programmable chips, to carry out desired functions.

The preferred features may be combined as appropriate, as would be apparent to a skilled person, and may be combined with any of the aspects of the invention.

Embodiments of the present invention are described below by way of example only. These exemplary embodiments represent the best ways of putting the invention into practice that are currently known to the Applicant although they are not the only ways in which this could be achieved. The description sets forth the functions of the exemplary embodiments and the sequence of steps for constructing and operating the exemplary embodiment. However, the same or equivalent functions and sequences may be accomplished by different embodiments.

There are a number of different multiple-microphone signal separation algorithms which have been developed. One exemplary embodiment is adaptive decorrelation filtering (ADF) which is an adaptive filtering type of signal separation algorithm based on second-order statistics. The algorithm is designed to deal with convolutive mixtures, which is often more realistic than instantaneous mixtures due to the transmission delay from source to microphone and the reverberation in the acoustic environment. The algorithm also assumes that the number of microphones is equal to the number of sources. However, with careful system design and adaptation control, the algorithm can group several noise sources into one and performs reasonably well with fewer microphones than sources. ADF is described in detail in "Multi-channel signal separation by decorrelation" by Weinstein, Feder and Oppenheim, (IEEE Transactions on Speech and Audio Processing, vol. 1, no. 4, pp. 405-413, October 1993) and a simplification and further discussion on adaptive step control is described in "Adaptive Co-channel speech separation and recognition" by Yen and Zhao, (IEEE Transactions on Speech and Audio Processing, vol. 7, no. 2, pp. 138-151, March 1999).

The ADF was developed based on a model for co-channel environment. Under this environment, the signals captured by the microphones, $x_0(n)$ and $x_1(n)$, are convolutive mixtures of signals from two independent sound sources, $s_0(n)$ and $s_1(n)$. Here n is the time index in the fullband domain. Without losing generality, $s_0(n)$ can be defined as the target source for $x_0(n)$ and $s_1(n)$ as the target source for $x_1(n)$. For a given microphone, the source that is not the target is the interfering source. The relation between the source and microphone signals can be modelled mathematically as:

$$x_0(n)=s_0(n)+H_{01}\{s_1(n)\}$$

$$x_1(n)=s_1(n)+H_{10}\{s_0(n)\} \quad (5)$$

where linear filters $H_{01}(z)$ and $H_{10}(z)$ model the relative cross acoustic paths. These filters can be approximated by N-tap finite impulse response (FIR) filters. The sources are relatively better captured by the microphones that target them if:

$$|H_{01}(z)H_{10}(z)|<1 \quad (6)$$

for all frequencies. This is the preferable condition for the ADF algorithm to prevent permutation problem due to the ambiguity on target sources. This co-channel model and the ADF algorithm can both be extended for more microphones and signal sources.

FIG. 1 shows a block diagram of the ADF signal separation system for two microphones, which uses two adaptive filters 101, 102 to estimate and track the underlying relative cross acoustic paths from signals $x_0(n)$ and $x_1(n)$ received from the two microphones. Using these filters, the system can separate the sources from these convolutive mixtures, and thus restore the source signals. Depending on the sampling frequency, the reverberation in the environment, and the separation of sources and microphones, acoustic paths typically require FIR filters with hundreds or even thousands of taps to be modeled digitally. Therefore, the tail-lengths of the adaptive filters A(z) and B(z) can be quite substantial. This is further complicated because audio signals are usually highly colored and dynamic and acoustic environments are often time-varying. As a result, satisfactory tracking performance may require a large amount of computational power.

Figure 2:
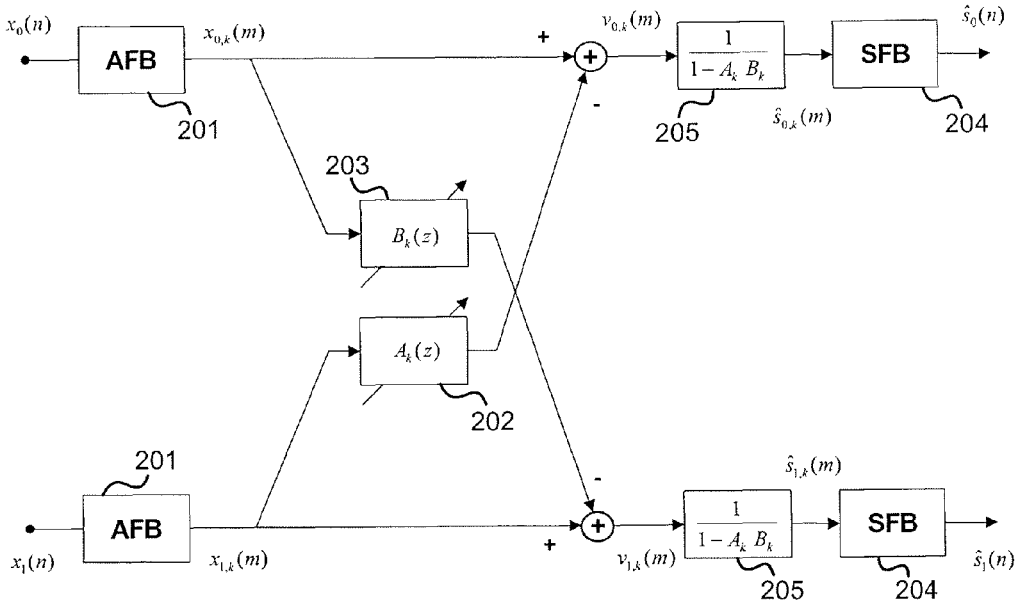
FIG. 2 shows a block diagram of the preferred ADF algorithm.

FIG. 2 shows a block diagram of an optimized ADF algorithm where the signal separation is implemented in the frequency (subband) domain. The block diagram shows two input signals, $x_0(n)$, $x_1(n)$, which are received by different microphones. Where one of the microphones is located closer to the user's mouth, the signal received by that microphone (e.g., $x_0(n)$) can comprise relatively more speech (e.g., $s_0(n)$) whilst the signal received by the other microphone (e.g., $x_1(n)$) can comprise relatively more noise (e.g., $s_1(n)$). Therefore, the speech is the target source in $x_0(n)$ and the interfering source in $x_1(n)$, while the noise is the target source in $x_1(n)$ and the interfering source in $x_0(n)$. The operation of the algorithm can be described with reference to the flow diagram shown in FIG. 3. Although the exemplary embodiments shown and described herein relate to two microphones, the systems and methods described may be extended to more than two microphones.

The term 'speech' is used herein in relation to a source signal to refer to the desired speech signal from a user that is to be preserved and restored in the output. The term 'noise' is used herein in relation to a source signal to refer to an undesired competing signal (which originates from multiple actual sources), including background speech, which is to be suppressed or removed in the output.

The input signals $x_0(n)$, $x_1(n)$ are decomposed into subband signals $x_{0,k}(m)$, $x_{1,k}(m)$ (block 301) using an analysis filter bank (AFB) 201, where k is the subband index and m is the time index in the subband domain. Because the bandwidth of each subband signal is only a fraction of the full bandwidth, the subband signals can be down-sampled for processing efficiency without losing information (i.e., without violating the Nyquist sampling theorem). An exemplary embodiment of the AFB is the Discrete Fourier Transform (DFT) analysis filter bank, which decomposes a fullband signal into subband signals of equally spaced bandwidths:

$$x_{i,k}(m) = \sum_{n=0}^{W-1} x(mD+n)w(n)\exp\left(-\frac{j2\pi nk}{K}\right),\ k = 0, 1, \ldots, \frac{K}{2} \tag{7}$$

where D is the down-sample factor, K is the DFT size, and w(n) is the prototype window of length W designed to achieve the intended cross-band rejection. This shows just one example of an AFB which may be used and depending on the type of the AFB, the subband signals can be either real or complex, and the bandwidth of the subbands can be either uniform or non-uniform. For AFB with non-uniform subbands, different down-sampling factor may be used in each subband.

Having decomposed the input signals (in block 301), an ADF algorithm is applied independently to each subband (block 302) using subband ADF filters $A_k(z)$ and $B_k(z)$, 202, 203. These filters are adapted by estimating and tracking the relative cross acoustic paths from the microphone signals ($H_{01,k}(z)$ and $H_{10,k}(z)$ respectively), with filter $A_k(Z)$ providing the coupling from the second channel (channel 1) into the first channel (channel 0) and filter $B_k(z)$ providing the coupling from the first channel (channel 0) into the second channel (channel 1). The subband ADF algorithm is described in more detail below. The output of the ADF algorithms comprises restored subband signals $\hat{s}_{0,k}(m)$, $\hat{s}_{1,k}(m)$ and these separated signals are then combined (block 303) to generate the fullband restored signals $\hat{s}_0(n)$ and $\hat{s}_1(n)$ using a synthesis filter bank (SFB) 204 that matches the AFB 201.

Figure 3:
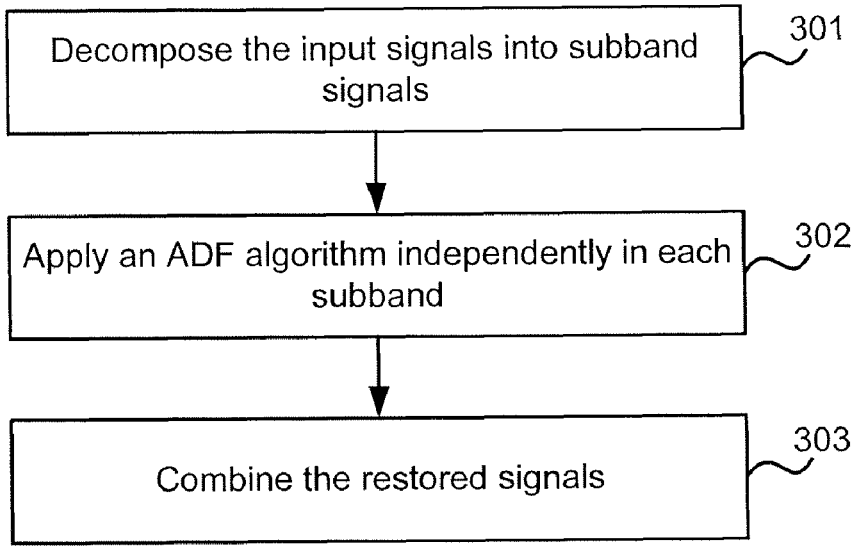
FIG. 3 shows a flow diagram of an exemplary method of operation of the algorithm shown in FIG. 2.

By using subbands as shown in FIGS. 2 and 3, each subband comprising a whiter input signal and a shorter filter-tail can be used in each subband due to down-sampling. This reduces the computational complexity and optimizes the convergence performance.

The subband filters $A_k(z)$ and $B_k(z)$ are FIR filters of length M with coefficients:

$$\bar{a}_k = [a_k(0)a_k(1)a_k(M-1)]^T$$

$$\bar{b}_k = [b_k(0)b_k(1)b_k(M-1)]^T \tag{8}$$

where the superscript T denotes vector transpose. The subband filter length, M, preferably needs to be approximately N/D, due to the down-sampling, in order to provide similar temporal coverage as a fullband ADF filter of length N. It will be appreciated that the filter length, M, may be different to (e.g., longer than) N/D.

Figure 4:
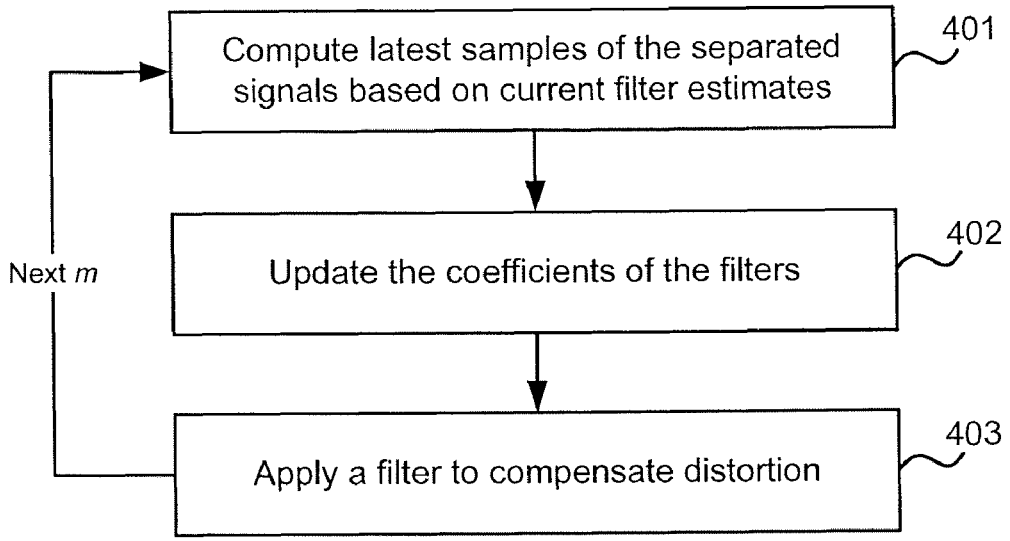
FIG. 4 shows a flow diagram of an exemplary subband implementation of ADF.

FIG. 4 shows a flow diagram of an example subband implementation of ADF. The flow diagram shows the implementation for a single subband and the method is performed independently for each subband k. In each adaptation step m, the latest samples of the separated signals $v_{0,k}(m)$ and $v_{1,k}(m)$ are computed (block 401) based on the current estimates of filters $A_k(z)$ and $B_k(z)$, where:

$$v_{0,k}(m) = x_{0,k}(m) - \bar{x}_{1,k}(m)^T \bar{a}_k^{(m-1)}$$

$$v_{1,k}(m) = x_{1,k}(m) - \bar{x}_{0,k}(m)^T \bar{b}_k^{(m-1)} \tag{9}$$

where the subband input signal vectors are defined as:

$$\bar{x}_{0,k}(m) = [x_{0,k}(m)x_{0,k}(m-1) \ldots x_{0,k}(m-M+1)]^T$$

$$\bar{x}_{1,k}(m) = [x_{1,k}(m)x_{1,k}(m-1) \ldots x_{1,k}(m-M+1)]^T$$

These computed values of the latest samples $v_{0,k}(m)$ and $v_{1,k}(m)$ are then used to update the coefficients of filters $A_k(z)$ and $B_k(z)$ (block 402) using the following adaptation equations:

$$\bar{a}_k^{(m)} = \bar{a}_k^{(m-1)} + \mu_{0,k}(m)\bar{v}_{1,k}^*(m)v_{0,k}(m)$$

$$\bar{b}_k^{(m)} = \bar{b}_k^{(m-1)} + \mu_{b,k}(m)\bar{v}_{0,k}^*(m)v_{1,k}(m) \tag{10}$$

where * denotes a complex conjugate, $\mu_{a,k}(m)$ and $\mu_{b,k}(m)$ are subband step-size functions (as described in more detail below) and where the subband separated signal vectors are defined as:

$$\bar{v}_{0,k}(m) = [v_{0,k}(m)v_{0,k}(m-1) \ldots v_{0,k}(m-M+1)]^T$$

$$\bar{v}_{1,k}(m) = [v_{1,k}(m)v_{1,k}(m-1) \ldots v_{1,k}(m-M+1)]^T$$

The separated signals may then be filtered (block 403) to compensate for distortion using the filter $(1-A_k(z)B_k(z))^{-1}$ 205. The output of the ADF algorithm comprises restored subband signals $\hat{s}_{0,k}(m)$ and $\hat{s}_{1,k}(m)$.

In this example, the control mechanism is implemented independently in each subband. In other examples, the control mechanism may be implemented across the full band or across a number of subbands (e.g., cross-band control).

Figure 5:
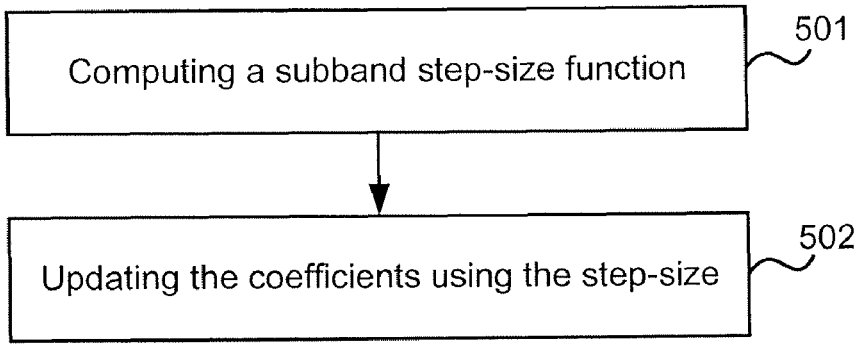
FIG. 5 shows a flow diagram of a method of updating the filter coefficients in more detail.

FIG. 5 shows a flow diagram of the method of updating the filter coefficients (e.g., block 402 from FIG. 4) in more detail. The method comprises computing a subband step-size function (block 501) and then using the computed subband step-size function to update the coefficients (block 502), e.g., using the adaptation equations given above.

The step-size functions $\mu_{a,k}(m)$ and $\mu_{b,k}(m)$ control the rate of filter adaptation and may also be referred to the adaption gain function or adaptation gain. An upper bound of step-size for the subband implementation is:

$$0 < \mu_{a,k},\ \mu_{b,k} < \frac{2}{M(\sigma_{x0,k}^2 + \sigma_{x1,k}^2)} \tag{11}$$

where $\sigma^2_{xi,k} = E\{|x_{i,k}(m)|^2\}$, i=0,1, represents the power of subband microphone signal $x_{i,k}(m)$.

According to this upper bound, the step-size may be defined as:

$$\mu_{a,k} = \mu_{b,k} = \frac{2\gamma}{M(\sigma_{x0,k}^2 + \sigma_{x1,k}^2)},\ 0 < \gamma < 1 \tag{12}$$

This provides a power-normalized ADF algorithm whose adaptation is insensitive to the input level of the microphone signals. This step-size function is generally sufficient for applications with stationary signals, time-invariant mixing channels, and moderate cross-channel leakage.

However, for applications with dynamic signals, time-varying channels, and high cross-channel leakage, such as when separating target speech from dynamic interfering noise with closely-spaced microphones, the adjustment of step-size may be further refined to optimize performance. Three further optimizations are described below:

Power normalization

Adaption direction control

Target ratio control

Any one or more of these optimizations may be used in combination with the methods described above, or alternatively none of these optimizations may be used.

The input signals are time-varying and as a result the power levels of the input signals, $\sigma_{0,k}^2$ and $\sigma_{1,k}^2$ are also time-varying. Dynamic tracking of the power levels in each subband can be achieved by averaging the input power in each subband with a 1-tap recursive filter with adjustable time coefficient or weighted windows with adjustable time span. The resulting input power estimates, $\hat{\sigma}_{0,k}^2$ and $\hat{\sigma}_{1,k}^2$ are used in place of $\sigma_{0,k}^2$ and $\sigma_{1,k}^2$ in the step-size function. The ability to follow the increase in input power levels promptly reduces instability and the ability to follow the decrease in input power levels within a reasonable time frame avoids unnecessarily stalling of the adaptation (because the step-size is reduced as power increases) and enhances the dynamic tracking ability of the system. However, when source signals are absent, it is desirable that the input power estimates do not drop to the level of noise floor. This prevents the negative impact on filter adaption during these idle periods. Therefore, the time coefficient or weighted windows should be adjusted such that the averaging period of the input power estimates are short within normal power level variation but long when incoming power level is significantly lower.

Adaptation direction control comprises controlling the direction of the step-size, $\mu_{a,k}$ and $\mu_{b,k}$ through the addition of an extra term in the equation. This term stops the filter from diverging under certain circumstances. The following description provides a derivation of the extra term.

Previous work (as described in "*Co-Channel Speech Separation Based On Adaptive Decorrelation Filtering*" by K. Yen, Ph.D. Dissertation, University of Illinois at Urbana-Champaign, 2001) showed in the fullband solution, that for the ADF adaptive filters A(z), B(z) (as shown in FIG. 1) to converge towards the desired solutions, the real part of the eigenvalues of the correlation matrices $P_{XVi}=E\{\bar{v}_i(n)\bar{x}_i^T(n)\}$ for i=0,1, must be positive. This condition can be satisfied if the cross-channel leakage of the acoustic environment is such that each signal source is relatively better captured by its target microphone at all frequencies, (i.e., if the speech is relatively better captured by the first microphone than by the second microphone and the noise is relatively better captured by the second microphone than by the first microphone at all frequencies).

In many headset and handset applications, however, this may not always be the case for a number of reasons: the spacing between the microphones is short compared to the distances from the microphones to their relative targets (i.e., the distance between the first microphone and the user's mouth and the distance between the second microphone and the noise sources); the signals are dynamic in nature and may be sporadic; and the acoustic environment varies with time. All these factors mean that, in the subband implementation, where the cross-correlations can be complex numbers, the eigenvalues of the correlation matrices $P_{XVi,k}=E\{\bar{v}_{i,k}^*(m)\bar{x}_{i,k}^T(m)\}$ for a subband may have negative real parts.

The eigenvalues of the cross-correlation matrix $P_{XVi,k}=E\{\bar{v}_{i,k}^*(m)\bar{x}_{i,k}^T(m)\}$ represent the modes for the adaptation of filter $A_k(Z)$:

$$\bar{a}_k^{(m)}=\bar{a}_k^{(m-1)}+\mu_{a,k}(m)\bar{v}_{1,k}^*(m)v_{0,k}(m) \tag{13}$$

If the adaptation step-size $\mu_{a,k}$ is positive, the modes associated with the eigenvalues with positive real parts converge, while the modes associated with the eigenvalues with negative real parts diverge. If, however, $\mu_{a,k}$ is negative, the opposite occurs. The stability of the algorithm can therefore be optimized by adding a complex phase term in $\mu_{a,k}$ to "rotate" the eigenvalues of $P_{XV\,1,k}$ to the positive portion of the real axis such that the modes do not diverge, i.e., the added phase in $\mu_{a,k}$ and the phase of the eigenvalues add up to 0. Tracking the eigenvalues of $P_{XV\,1,k}$ is, however, computationally intensive and therefore an approximation may be used, as described below.

The phases of the eigenvalues of $P_{XV\,1,k}$ are generally similar to each other and can be approximated by the phase of the cross-correlation between $x_{1,k}(m)$ and $v_{1,k}(m)$ $$\sigma_{x1v1,k}=r_{x1v1,k}(0)=E\{x_{1,k}(m)v_{1,k}^*(m)\} \tag{14}$$

Therefore, instead of estimating $P_{XV1,k}$ and computing its eigenvalues, it is sufficient to estimate and track $\sigma_{x1v1,k}$ and adjust the direction of $\mu_{a,k}(m)$ (which may also be referred to as the phase of $\mu_{a,k}(m)$) based on its phase $\angle\hat{\sigma}_{x1v1,k}$.

To incorporate direction control into $\mu_{a,k}(m)$, the previously derived equation for $\mu_{a,k}(m)$ can therefore be modified to give:

$$\mu_{a,k}=\frac{2\gamma\exp(-j\angle\sigma_{x1v1,k})}{M(\sigma_{x0,k}^2+\sigma_{x1,k}^2)} \tag{15}$$

This prevents the filter $A_k(Z)$ from diverging and optimizes its convergence when the phases of eigenvalues move away from 0. Similarly, the adaptation direction of the filter $B_k(Z)$ can be controlled by modifying the adaptation step-size $\mu_{b,k}(m)$ as:

$$\mu_{b,k}=\frac{2\gamma\exp(-j\angle\hat{\sigma}_{x0v0,k})}{M(\hat{\sigma}_{x0,k}^2+\hat{\sigma}_{x1,k}^2)} \tag{16}$$

where $\hat{\sigma}_{x0v0,k}$ is the estimate of $\sigma_{x0v0,k}=r_{x0v0,k}(0)=E\{x_{0,k}(m)v_{0,k}^*(m)\}$ is the cross-correlation between $x_{0,k}(m)$ and $v_{0,k}(m)$. In other examples, other functions may be used to track $\sigma_{x1v1,k}$ and adjust the direction of $\mu_{a,k}(m)$ based on $\angle\hat{\sigma}_{x1v1,k}$, such as $\cos(\angle_{x1v1,k})$ or $\mathrm{sgn}(\mathrm{Re}(\angle\sigma_{x1v1,k}))$.

The target ratio control optimization provides a further extra term in the equation for the adaptation step-size, $\mu_{a,k}(m)$ and $\mu_{b,k}(m)$, which reduces the adaptation rate of a filter in periods where its corresponding interfering source is inactive, e.g., noise for $A_k(z)$ and speech for $B_k(z)$. The purpose of the adaptive filters is to estimate and track the relative cross acoustic paths $H_{01}(z)$ and $H_{10}(z)$ respectively. If there is no interfering signal in a particular subband, the subband signals captured by the microphones cannot include any cross channel leakage and therefore any adaptation of the particular subband filter during such a period may result in increased misadjustment of the filter. The following description provides a derivation of the target ratio control term.

The microphone signal $x_{0,k}(m)$ may be considered the sum of two components: the target component $s_{0,k}(m)$ and the interfering component given by:

$$x_{0,k}(m)-s_{0,k}(m)=H_{01,k}\{s_{1,k}(m)\} \tag{17}$$

where $H_{01,k}$ is the relative cross acoustic path that couples the interfering source (the noise source) into $x_{0,k}(m)$, as estimated and tracked by filter $A_k(z)$.

The target ratio in $x_{0,k}(m)$ can be defined as:

$$TR_{0,k}=\frac{E\{|s_{0,k}(m)|^2\}}{E\{|x_{0,k}(m)|^2\}}=\frac{\sigma_{s0,k}^2}{\sigma_{x0,k}^2} \tag{18}$$

For adaptive filters designed to continuously track the variability in the environment, the filter coefficients generally do not stay at the ideal solution even after convergence. Instead, they randomly bounce in a region around the ideal solution. The expected mean-squared error between the current filter estimate and the ideal solution, or misadjustment of the adaptive filter, is proportional to both the adaptation step size and the power of the target signal. Therefore, the misadjustment for filter $A_k(Z)$, $M_{a,k}$, increases as the TR in $x_{0,k}(m)$ increases:

$$M_{a,k} \propto \mu_{a,k}\sigma_{s0,k}^2 = \frac{2\gamma\sigma_{s0,k}^2}{M(\sigma_{x0,k}^2+\sigma_{x1,k}^2)} \propto \frac{\sigma_{s0,k}^2}{(\sigma_{x0,k}^2+\sigma_{x1,k}^2)} \tag{19}$$

To counter-balance this effect, the adaptive step-size $\mu_{a,k}(m)$ may be adjusted by a factor of $(1-TR_{0,k})$. This has the effect that when $s_{1,k}(m)$ is inactive ($TR_{0,k}=1$), the adaptation of filter $A_k(z)$ is halted since there is no information about $H_{01,k}(z)$ to adapt upon. On the other hand, when $s_{0,k}(m)$ is inactive ($TR_{0,k}=0$), the adaptation of filter $A_k(z)$ proceeds with full speed to take advantage of the absence of unrelated information (the target signal). In practice, since the source signal $s_{0,k}(m)$ is not available, the restored signal $\hat{s}_{0,k}(m)$ can be used as an approximation. Therefore, the equation for $\mu_{a,k}(m)$ can be further modified as:

$$\mu_{a,k} = \frac{2\gamma\exp(-jL\hat{\sigma}_{x1v1,k})}{M(\hat{\sigma}_{x0,k}^2+\hat{\sigma}_{x1,k}^2)} \times \max\left(1-\frac{\hat{\sigma}_{s0,k}^2}{\hat{\sigma}_{x0,k}^2}, 0\right) \tag{20}$$

where: $\hat{\sigma}_{\hat{s}0,k}^2$ the estimate of $\sigma_{\hat{s}0,k}^2=E\{|\hat{s}_{0,k}(m)|^2\}$.

Similarly, the adaptation step-size $\mu_{b,k}(m)$ for the filter $B_k(z)$ can be further modified as:

$$\mu_{b,k} = \frac{2\gamma\exp(-jL\hat{\sigma}_{x0v0,k})}{M(\hat{\sigma}_{x0,k}^2+\hat{\sigma}_{x1,k}^2)} \times \max\left(1-\frac{\hat{\sigma}_{s1,k}^2}{\hat{\sigma}_{x1,k}^2}, 0\right) \tag{21}$$

where: $\hat{\sigma}_{\hat{s}1,k}^2$ is the estimate of $\sigma_{\hat{s}1,k}^2=E\{|\hat{s}_{1,k}(m)|^2\}$.

Equations (20) and (21) above include a 'max' function in order that the additional parameter which is based on TR cannot change the sign of the step-size, and hence the direction of the adaptation, even where the signals are noisy.

Equations (20) and (21) show one possible additional term which is based on TR. In other examples, the previous equations (12), (15) or (16) may be modified by the addition of a different term based on TR. In further examples, a term based on TR, such as shown above, may be added to equation (12) above, i.e., without the optimization introduced in equations (15) and (16).

Figure 6:
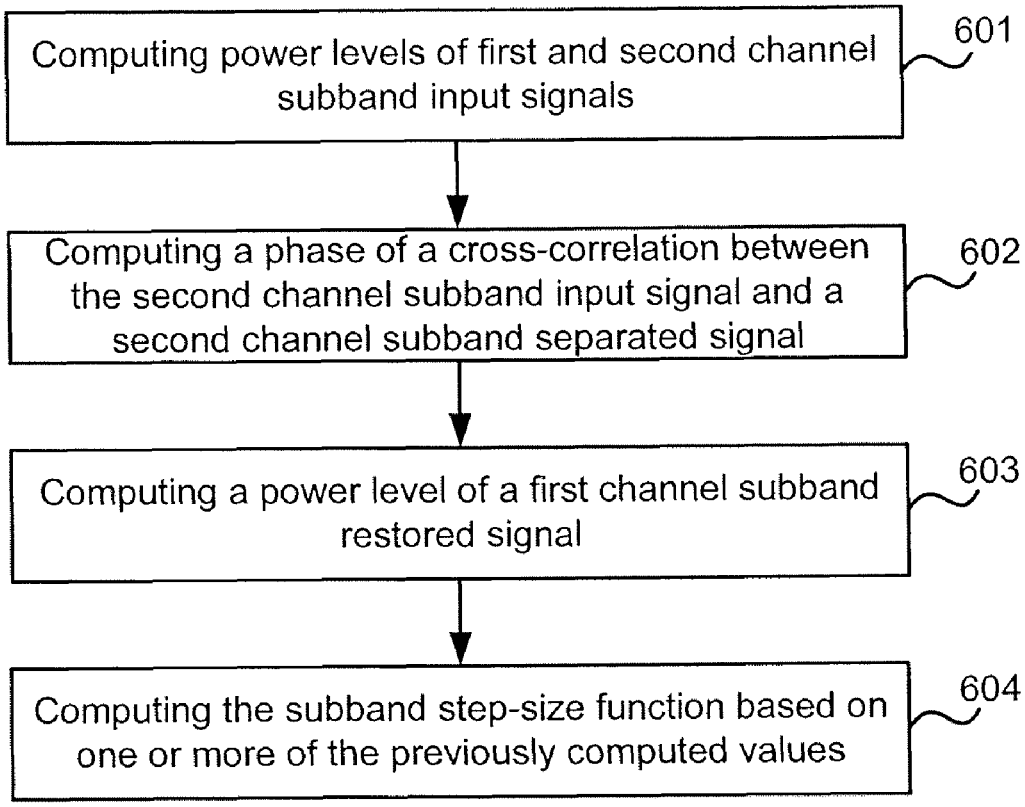
FIG. 6 shows a flow diagram of an exemplary method of computing a subband step-size function.

FIG. 6 shows a flow diagram of an example method of computing a subband step-size function (block 501 of FIG. 5) which uses all three optimizations described above, although other examples may comprise no optimizations or any number of optimizations and therefore one or more of the method blocks may be omitted. The method comprises: computing the power levels of the first and second channel subband input signals, $\hat{\sigma}_{0,k}^2$ and $\hat{\sigma}_{1,k}^2$ (block 601); computing the phase of a cross-correlation between the second channel subband input signal and the second channel subband separated signal, $\hat{\sigma}_{x1v1,k}$ (block 602); and computing a power level of the first channel subband restored signal, $\hat{\sigma}_{\hat{s}0,k}^2$ (block 603). These computed values are then used to compute the subband step-size function $\sigma_{a,k}$ (block 604), e.g., using one of equations (12), (15) and (20). The method may be repeated for each subband and may be performed in parallel for the other filter's subband step-size function $\mu_{b,k}$, e.g., using one of equations (12), (16) and (21) in block 604.

The ADF stage, as described above and shown in FIG. 2, performs signal separation and generates two output signals $\hat{s}_0(n)$ and $\hat{s}_1(n)$ from the two microphone signals $x_0(n)$ and $x_1(n)$. If the desired (user) speech source is located relatively closer to the first microphone (channel 0) than all other acoustic sources, the separated signal $\hat{s}_0(n)$ can be dominated by the desired speech and the separated signal $\hat{s}_1(n)$ can be dominated by other competing (noise) sources. Dependent upon the conditions, the SNR in separated signal $\hat{s}_0(n)$ may, for example, be as high as 15 dB or as low as 5 dB.

To further reduce the noise component in $\hat{s}_0(n)$, a post-processing stage may be used. The post-processing stage processes an estimation of the competing noise signal, $\hat{s}_1(n)$, which is noise dominant, and subtracts the correlated part of the noise signal from the estimation of speech signal, $\hat{s}_0(n)$. This approach is referred to as adaptive noise cancellation (ANC).

Figure 7:
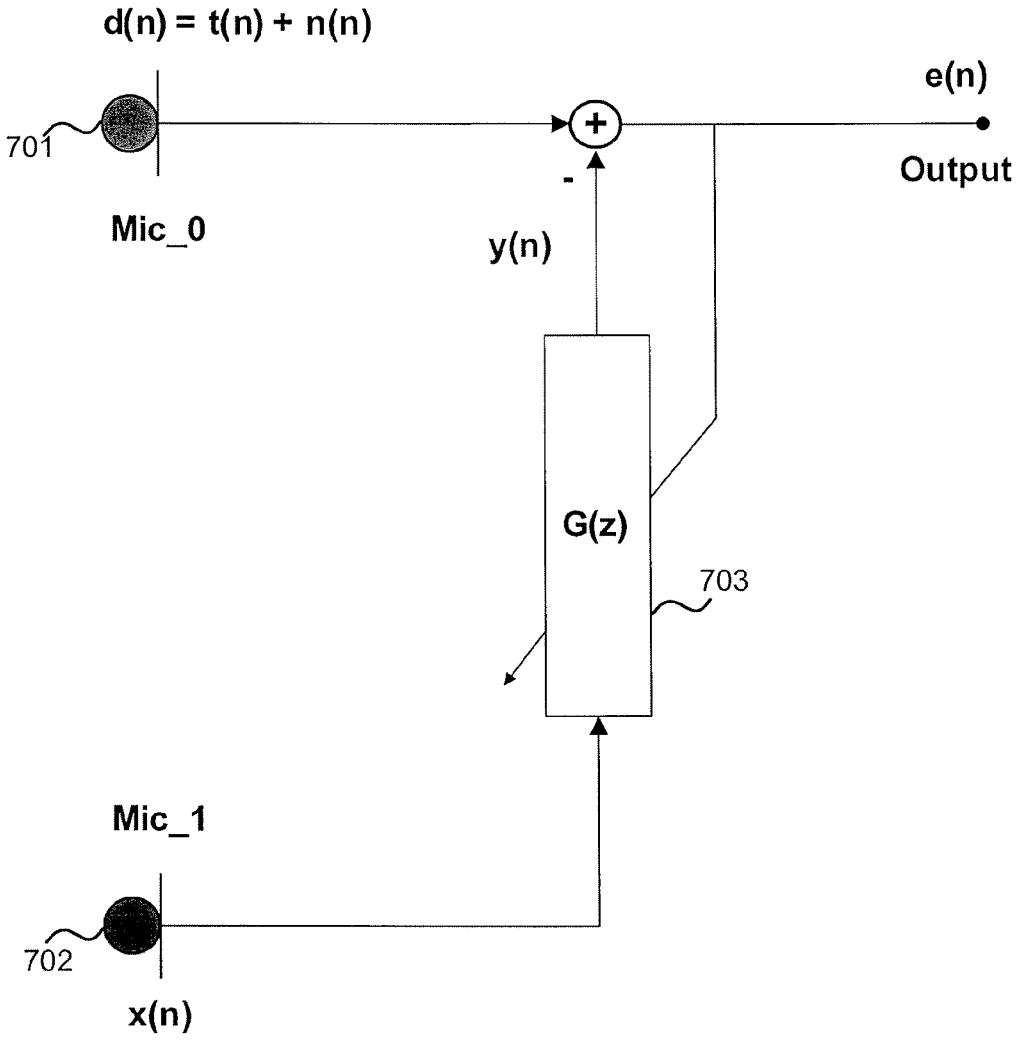
FIG. 7 is a schematic diagram of a fullband implementation of an adaptive noise cancellation (ANC) application using two inputs.

FIG. 7 is a schematic diagram of a fullband implementation of an ANC application using two inputs (microphone 0 (d(n)) 701 and microphone 1 (x(n)) 702), where d(n) contains the target signal t(n) corrupted by additive noise n(n), and x(n) is the noise reference that, for the purposes of the ANC algorithm, can be correlated to the additive noise n(n) but uncorrelated to the target signal t(n). However, where the ANC algorithm is used in a post-processing stage for applications where the microphone separation is much shorter than the microphone to source distances, the reference signal x(n) (which is output $\hat{s}_1(n)$ from the ADF algorithm) is a mix of target and noise signals. This difference between the assumption and the reality in certain applications may be addressed using a control mechanism described below with reference to FIG. 11.

In the structure shown in FIG. 7, the reference signal is processed by the adaptive finite impulse response (FIR) filter G(z) 703, whose coefficients are adapted to minimize the power of the output signal e(n). Where the assumption that the reference signal x(n) can be correlated to the additive noise n(n) and uncorrelated to the target signal t(n) holds true, the output of the adaptive filter y(n) converges to the additive noise n(n) and the system output e(n) converges to the target signal t(n).

Figure 8:
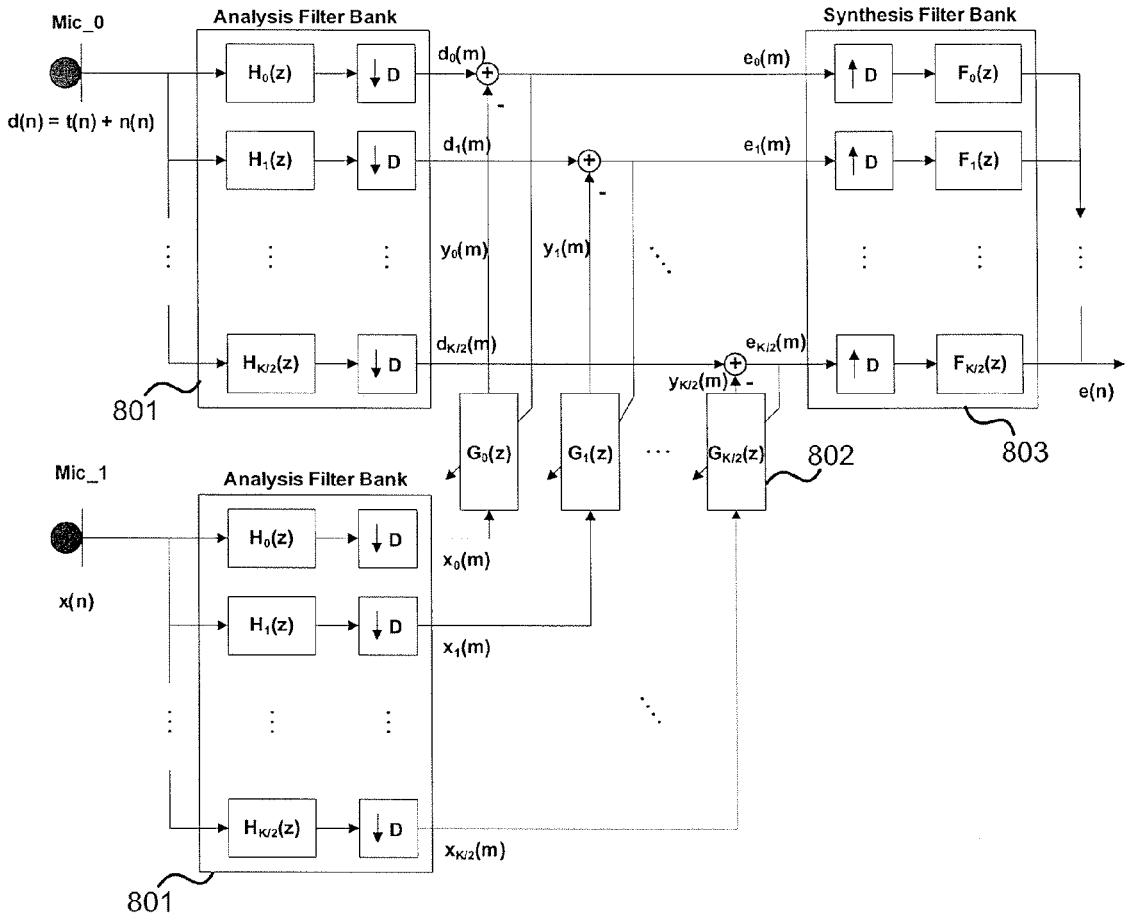
FIG. 8 is a schematic diagram of a subband implementation of an ANC application using two inputs.

Instead of using a fullband implementation, as shown in FIG. 7, a subband implementation may be used, as shown in FIG. 8. Use of a subband implementation reduces the computational complexity and optimizes the convergence rate. In this example a subband data re-using normalized least mean square (SB-DR-NLMS) algorithm is used although other adaptive filtering algorithms may alternatively be used. The data re-using implementation optimizes the convergence performance, although in other examples an alternative subband implementation of the NLMS algorithm may be used.

As described above, an AFB 801 may be used to decompose the fullband signals into subbands. In an example, a DFT analysis filter bank may be used to split the fullband signals into K/2+1 subbands, where K is the DFT size. As also described above, the subband signals may be down-sampled which makes the processing more efficient without losing information. If D is the down-sample factor, the relationship between the fullband time index n and the subband domain time index m may be given by: m=n/D.

Each subband signal $x_k(m)$ is modified by a subband adaptive filter $G_k(z)$ 802 and the coefficients of $G_k(z)$ are adapted independently in order to minimize the power of the error (or output) signal $e_k(m)$ (the mean-squared error) in the corresponding subband (where k is the subband index). The subband error signals $e_k(m)$ are then assembled by a SFB 803 to obtain the fullband output signal e(n). If the noise is fully cancelled, the output signal e(n) is equal to the target signal t(n). The subband signals $d_k(m)$, $x_k(m)$, $y_k(m)$ and $e_k(m)$ are complex signals and the subband filters $G_k(z)$ have complex coefficients.

Each subband filter $G_k(z)$ 802 may be implemented as a FIR filter of length $M_P$ with coefficients $\bar{g}_k$ given by:

$$\bar{g}_k=[g_k(0)g_k(1)\ldots g_k(M_P-1)]^T \tag{22}$$

Based on the NLMS algorithm, the adaptation equation for $\bar{g}_k$ is defined as:

$$\bar{g}_k^{(m)}=\bar{g}_k^{(m-1)}+\mu_k(m)\bar{x}_k^*(m)e_k(m) \tag{23}$$

where superscript * represents the complex conjugate and where:

the input vector $\bar{x}_k(m)$ is defined as:

$$\bar{x}_k(m)=[x_k(m)x_k(m-1)\ldots x_k(m-M_P+1)]^T \tag{24}$$

the output signal (which may also be referred to as the error signal) is:

$$e_k(m)=d_k(m)-y_k(m) \tag{25}$$

the output of the adaptive filter is:

$$y_k(m)=\bar{x}_k^T(m)\bar{g}_k^{(m-1)} \tag{26}$$

and the adaptation step-size in each subband is given by:

$$\mu_{p,k}(m)=\frac{\gamma_p}{M_P\hat{\sigma}_{x,k}^2(m)},\ 0<\gamma_P<2 \tag{27}$$

The adaptation step-size $\mu_{p,k}(m)$ is chosen so that the adaptive algorithm stays stable. It is also normalized by the power of the subband reference signal $x_k(m)$, $\hat{\sigma}_{x,k}^2(m)=E\{|x_k(m)|^2\}$, which can be estimated using one of a number of methods, such as the average of the latest $M_P$ samples:

$$\hat{\sigma}_{x,k}^2(m)=\frac{|\bar{x}_k(m)|^2}{M_P}==\frac{1}{M_P}\sum_{l=0}^{M_P-1}|x_k(m-l)|^2 \tag{28a}$$

or using a 1-tap recursive filter:

$$\hat{\sigma}_{x,k}^2(m)=(1-\alpha)\hat{\sigma}_{x,k}^2(m-1)+\alpha|x_k(m)|^2 \tag{28b}$$

with $\alpha\approx 1/M_P$.

Figure 9:
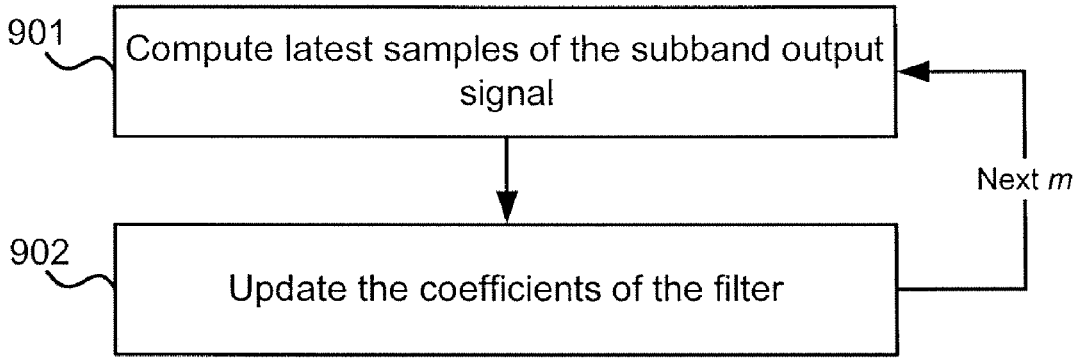
FIG. 9 shows a flow diagram of an exemplary method of ANC.

FIG. 9 shows a flow diagram of an examplary method of ANC, for a single subband, comprising computing the latest samples of the subband output signal $e_k(m)$ (block 901) and updating the coefficients of the filter $\bar{g}_k$ (block 902), e.g., using equations (23)-(27) above.

Figure 10:
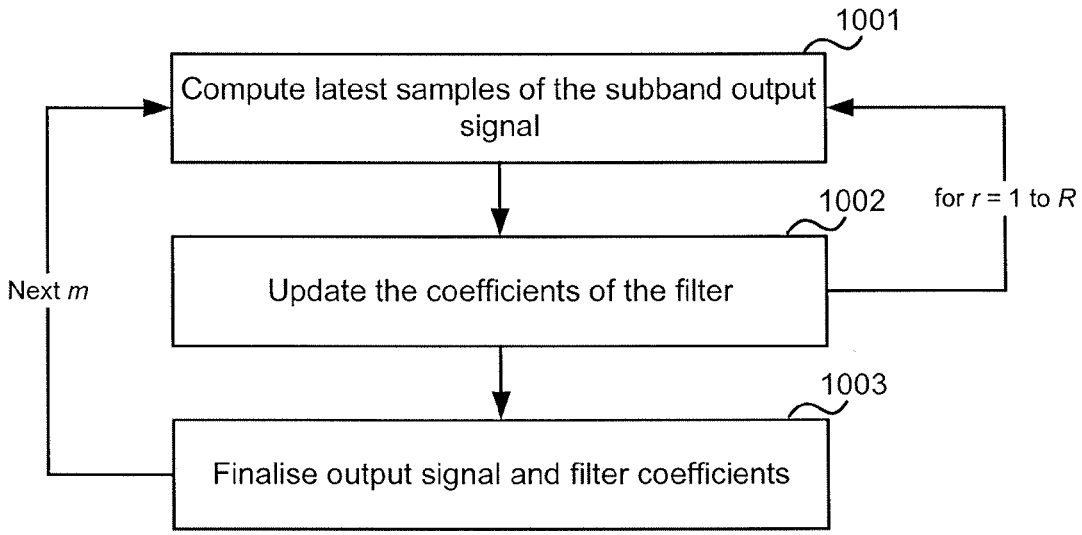
FIG. 10 shows a flow diagram of data re-using.

To include data re-using into the subband NLMS algorithm, multiple iterations of signal filtering and filter adaptation are executed for each sample instead of a single iteration, as follows and as shown in FIG. 10:

For each new samples $d_k(m)$ and $x_k(m)$, the filter estimate is initialized:

$$\bar{g}_k^{(m),(0)}=\bar{g}_k^{(m-1)} \tag{29}$$

From iterations r=1 through R, the output signal is computed based on the previous filter estimate (block 1001) and the filter estimate is updated based on the newly computed output signal (block 1002):

$$y_k^{(r)}(m)=\hat{x}_k^T(m)\bar{g}_k^{(m),(r-1)}$$

$$e_k^{(r)}(m)=d_k(m)-y_k^{(r)}(m)$$

$$\bar{g}_k^{(m),(r)}=\bar{g}_k^{(m),(r-1)}+\mu_{p,k}^{(r)}(m)\bar{x}_k^*(m)e_k^{(r)}(m) \tag{30}$$

where the adaptation step-size function may be adjusted down as r increases (for better convergence results).

For example:

$$\mu_{p,k}^{(r)}(m)=2^{1-r}\mu_{p,k}(m)=\frac{2^{1-r}\gamma_p}{M_P\hat{\sigma}_{x,k}^2(m)} \tag{31}$$

Having performed all the iterations on the particular sample, the output signals and filter estimate are finalized with the results from iteration R (block 1003):

$$y(m)=y_k^{(R)}(m)$$

$$e_k(m)=e_k^{(R)}(m)$$

$$\bar{g}_k^{(m)}=\bar{g}_k^{(m),(R)} \tag{32}$$

and the process is then repeated for the next sample.

The updating of the filters (blocks 902 and 1002) may be performed as shown in FIG. 5, by computing a subband step-size function (block 501, e.g., using any of equations (27)-(34)) and then using this step-size function to update the filter coefficients (block 502).

As described above, the reference signal x(n) (which is output $\hat{s}_1(n)$ from the ADF algorithm) is a mix of target and interference signals. This means that the assumption within ANC does not hold true. This may be addressed using a control mechanism which modifies the adaptation step size $\mu_{p,k}(m)$ and this control mechanism, (which may be considered an implementation of block 501) can be described with reference to FIG. 11.

The control mechanism defines a subset of subbands $\Omega_{SP}$ which comprises those subbands in the frequency range where most of the speech signal power exists. This may, for example, be between 200 Hz and 1500 Hz. The particular frequency range which is used may be dependent upon the microphones used. Within subbands in the subset $\Omega_{SP}$, the power of the subband error (or output) $e_k(m)$ would be stronger than the power of the subband noise reference $x_k(m)$ if the target speech presents in the given subband, i.e., $\hat{\sigma}_{e,k}(m)>\hat{\sigma}_{x,k}^2(m)$.

For subbands within the subset ($k\in\Omega_{SP}$, 'Yes' in block 1101) a binary decision is reached independently by comparing the output (or error) signal power $\hat{\sigma}_{e,k}(m)$ and the noise reference power $\hat{\sigma}_{x,k}^2(m)$ in the given subband. If $\hat{\sigma}_{e,k}^2(m)>\hat{\sigma}_{x,k}^2(m)$, ('Yes' in block 1102), the filter adaptation is halted to prevent distorting the target speech (block 1104). Otherwise the filter adaptation is performed as normal which involves computing the step-size function (block 1105), e.g., using equation (27) or (31).

For subbands which are not in the subset ($k\notin\Omega_{SP}$, 'No' in block 1101), a binary decision is reached dependent on the decisions which have been made for the subbands within the subset (i.e., based on decisions made in block 1102). If the number of the subbands in the subset (i.e., $k\in\Omega_{SP}$) where filter adaptation is halted reaches a preset threshold, Th, (as determined in block 1106) the filter adaptation in all subbands not in the subset ($k \in \Omega_{SP}$) is halted (block 1104) to prevent distorting the target speech. Otherwise, the filter adaptation is continued as normal (block 1105). The value of the threshold, Th, (as used in block 1106) is a tunable parameter. In this control mechanism, the adaptation for subbands which are not in the subset (i.e., $k \in \Omega_{SP}$) is driven based on the results for subbands within the subset (i.e., $k \in \Omega_{SP}$). This accommodates any lack of reliability on power comparison results in these subbands.

Figure 11:
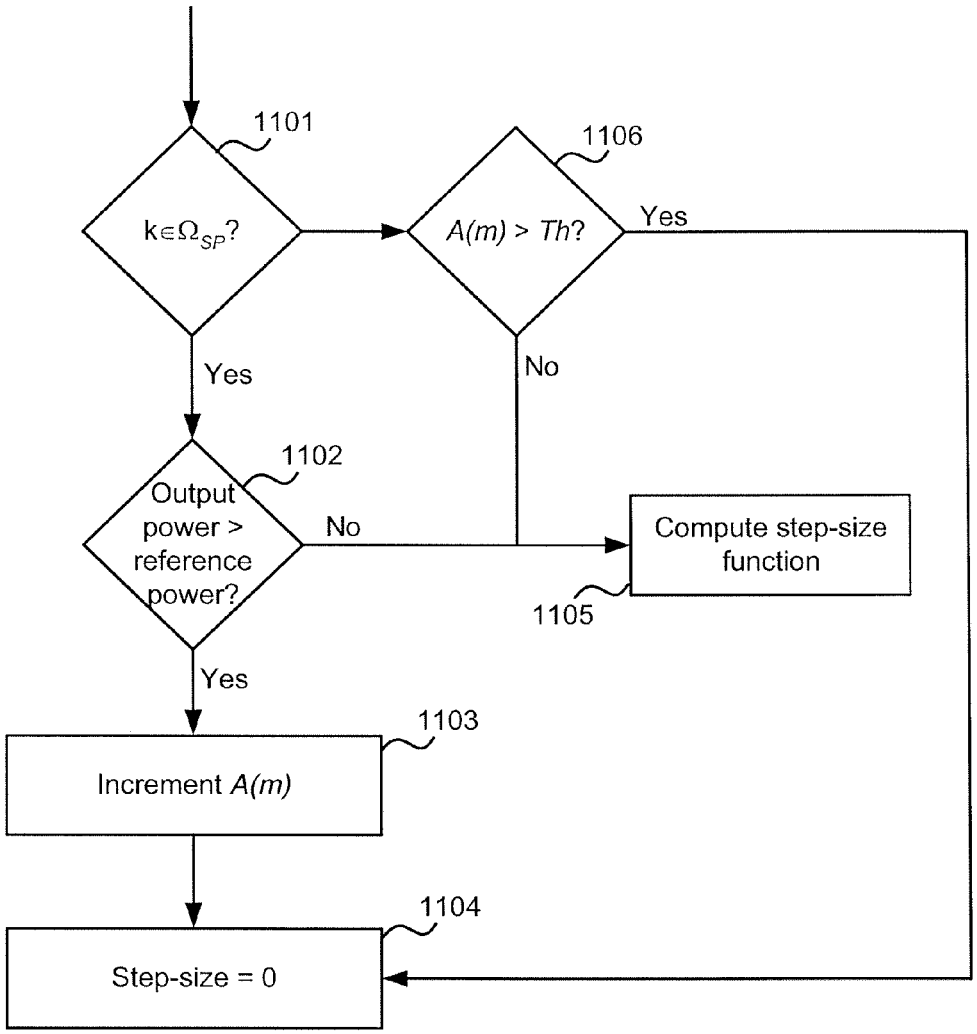
FIG. 11 shows a flow diagram of an exemplary control mechanism for ANC.

The example in FIG. 11 shows the number of subbands in the subset where filter adaptation is halted denoted by parameter A(m) and this parameter is incremented (in block 1103) for each subband (in time interval m) where the conditions which result in the halting of the adaptation are met (following a 'Yes' in block 1102). In other examples, this may be tracked in different ways and another example is described below.

The control mechanism shown in FIG. 11 and described above can be described mathematically as shown below. The adaptation step-size is defined as:

$$\mu_{p,k}(m) = \frac{\gamma_p f_k(m)}{M_P \hat{\sigma}^2_{x,k}(m)} \tag{33}$$

where for subbands $k \in \Omega_{SP}$:

$$f_k(m) = \begin{cases} 1, & \text{if } \hat{\sigma}^2_{x,k}(m) > \hat{\sigma}^2_{e,k}(m) \\ 0, & \text{otherwise.} \end{cases}$$

and for subbands $k \in \Omega_{SP}$:

$$f_k(m) = \begin{cases} 1, & average_{l \in \Omega_{SP}} f_l(m) > Th \\ 0, & \text{otherwise.} \end{cases}$$

The threshold Th is a tunable parameter with a value between 0 and 1. The average of $f_k(m)$ for $k \in \Omega_{SP}$ indicates the likelihood that the interference signal dominates over the target signal and which therefore provides circumstances suitable for adapting the SB-NLMS filter. Equation (33) includes a power normalization factor $\hat{\sigma}_{x,k}(m)$.

Equation (33) above does not show the adjustment of step-size as shown in equation (31) and described above. In another example, using the SB-DR-NLMS algorithm, the adaptation step-size may be defined as:

$$\mu_{p,k}(m) = \frac{2^{1-r}\gamma_p f_k(m)}{M_P \hat{\sigma}^2_{x,k}(m)} \tag{34}$$

where for subbands $k \in \Omega_{SP}$:

$$f_k(m) = \begin{cases} 1, & \text{if } \hat{\sigma}^2_{x,k}(m) > \hat{\sigma}^2_{e,k}(m) \\ 0, & \text{otherwise.} \end{cases}$$

and for subbands $k \notin \Omega_{SP}$:

$$f_k(m) = \begin{cases} 1, & average_{l \in \Omega_{SP}} f_l(m) > Th \\ 0, & \text{otherwise.} \end{cases}$$

To further reduce the noise, a single-channel NR may also be used. Single-channel NR algorithms are effective in suppressing stationary noise and although they may not be particularly effective where the SNR is low (as described above), the signal separation and/or post-processing described above reduce the noise on the input signal such that the SNR is optimized prior to input to the single-channel NR algorithm.

Figure 12:
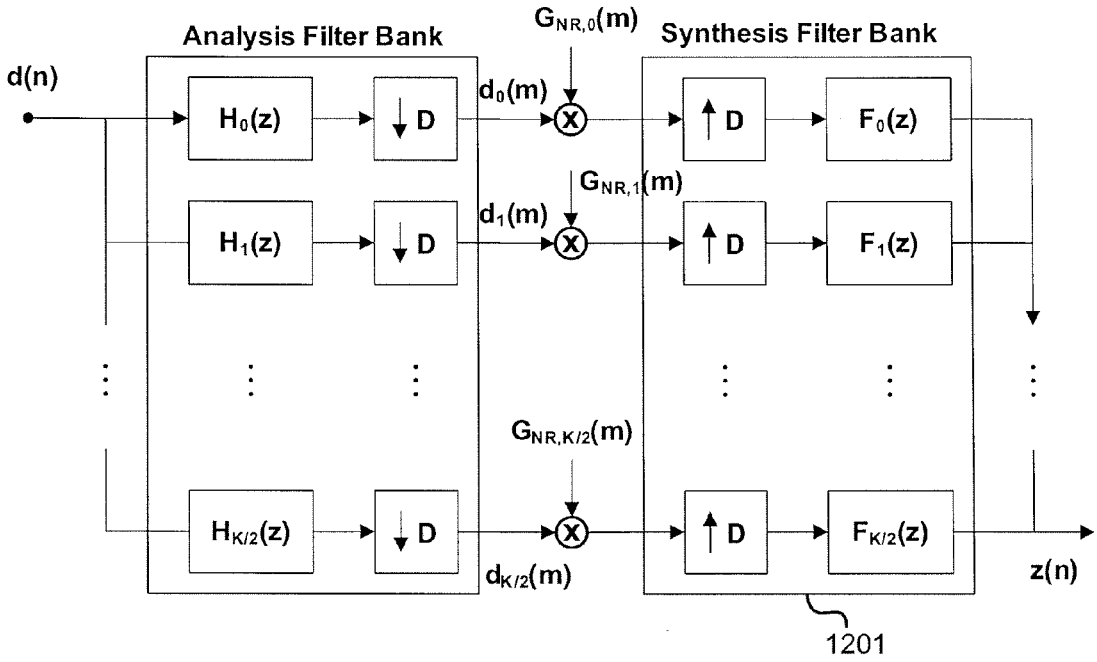
FIG. 12 shows a block diagram of a single-channel NR algorithm.
Figure 13:
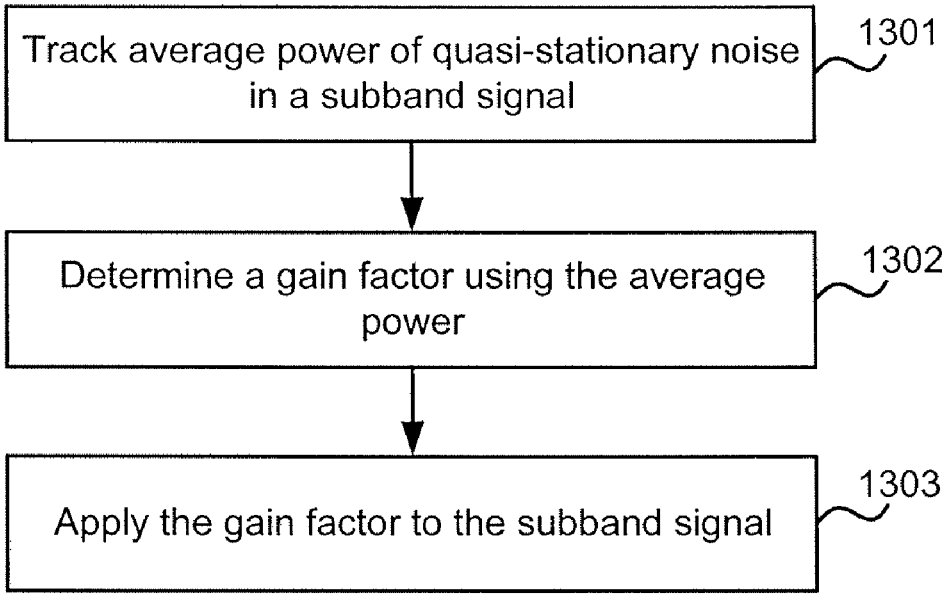
FIG. 13 is a flow diagram of an exemplary method of operation of the algorithm shown in FIG. 12.

FIG. 12 shows a block diagram of a single-channel NR algorithm and the algorithm is also shown in the flow diagram in FIG. 13. The input is a noisy speech signal d(n) and the algorithm distinguishes noise from speech by exploring the statistical differences between them, with the noise typically varying at a much slower rate than the speech. The implementation shown in FIG. 12 is again a subband implementation and for each subband k, the average power of the quasi-stationary background noise is tracked (block 1301). This average noise power is then used to estimate the subband SNR and thus decide a gain factor $G_{NR,k}(m)$, ranging between 0 and 1, for the given subband (block 1302). The algorithm then applies $G_{NR,k}(M)$ to the corresponding subband signal $d_k(m)$ (block 1303).

This generates modified subband signals $z_k(m)$, where:

$$z_k(m) = G_{NR,k}(m) d_k(m) \tag{35}$$

and the modified subband signals are subsequently combined by a DFT synthesis filter bank 1201 to generate the output signal z(n).

Figure 14:
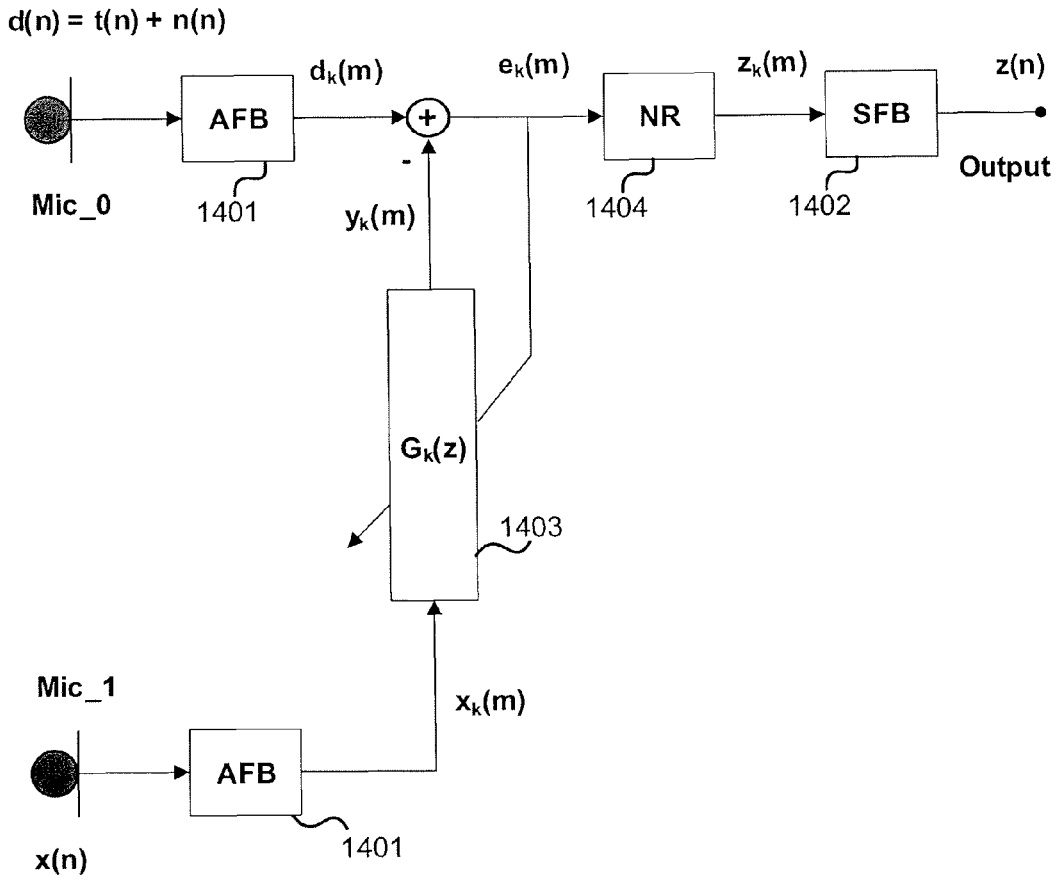
FIGS. 14 and 15 show block diagrams of two exemplary arrangements which integrate ANC and NR algorithms.
Figure 15:
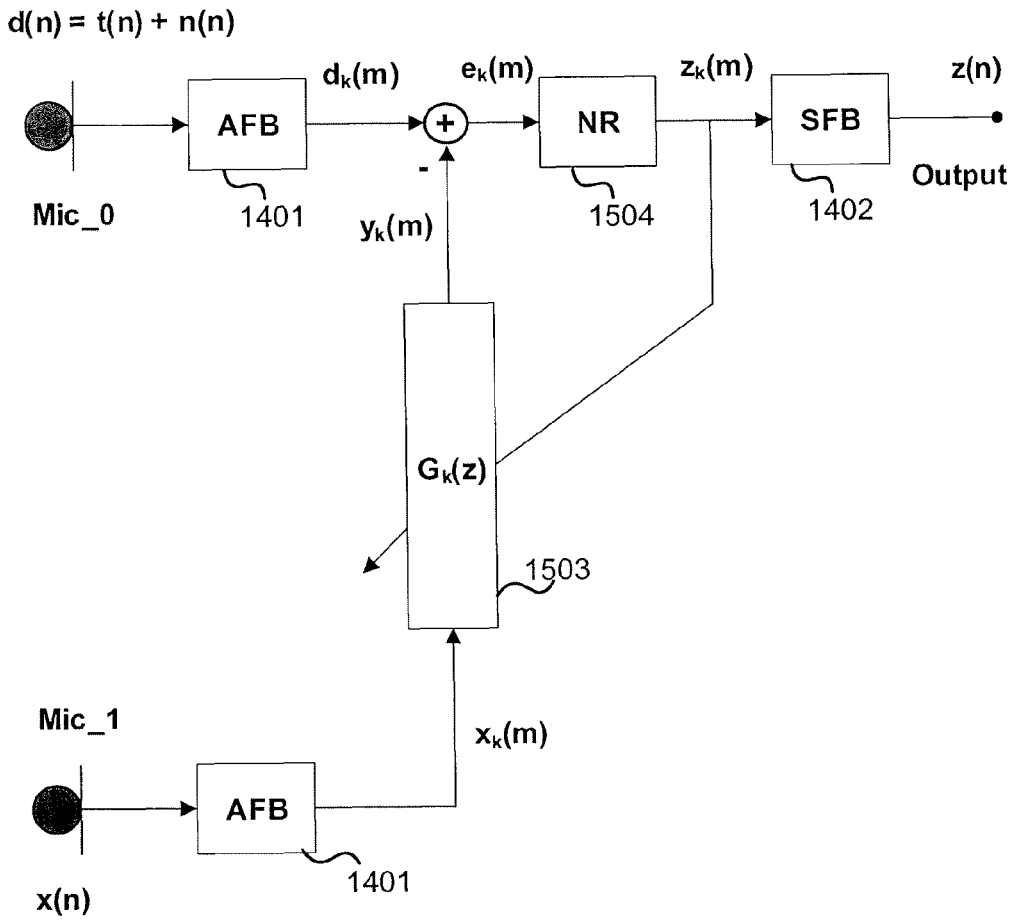

FIGS. 14 and 15 show block diagrams of two examplary arrangements which integrate the ANC and NR algorithms described above. As shown in these Figures, when the two algorithms are integrated, the AFB 1401 (e.g., using DFT analysis) and SFB 1402 may be applied at the front and the back of the combination of modules, rather than at the front and back of each module. The same is true if one or both of the ANC and NR algorithms are combined with the ADF algorithm described above.

In the arrangement shown in FIG. 14, the ANC algorithm (using filter $G_k(z)$ 1403) tries to cancel the stationary noise component in the input d(n) that is correlated to the noise reference x(n). While the power of the stationary noise is reduced, the relative variation in the residual noise increases. This effect is further augmented and exposed by the NR algorithm 1404 and thus an unnatural noise floor is generated.

There are a number of different techniques to mitigate against this, such as slowing down the adaptation rate of the ANC filter (e.g., through selection of a smaller step-size constant $\gamma_p$) or reducing the data re-using order R of the SB-DR-NLMS algorithm. An alternative to these is to use the arrangement shown in FIG. 15.

In the integrated arrangement of FIG. 15, if stationary background noise exists and dominates, the NR gain factors $G_{NR,k}(m)$ (in element 1504) can lower toward 0 to attenuate the error signal $e_k(m)$ (as described above) and effectively reduce the adaptation rate of the filter $G_k(z)$ 1503. This reduces the relative variances in the residual noise and thus controls the "musical" or "watering" artifact, which may be experienced using the arrangement shown in FIG. 14. If, however, stationary background noise is absent or the dynamic components such as non-stationary noise and target speech become dominant, the NR gain factors $G_{NR,k}(m)$ can rise toward 1, and the adaptation rate of the filter $G_k(z)$ can return to normal. This maintains the NR capability of the system.

Figure 16:
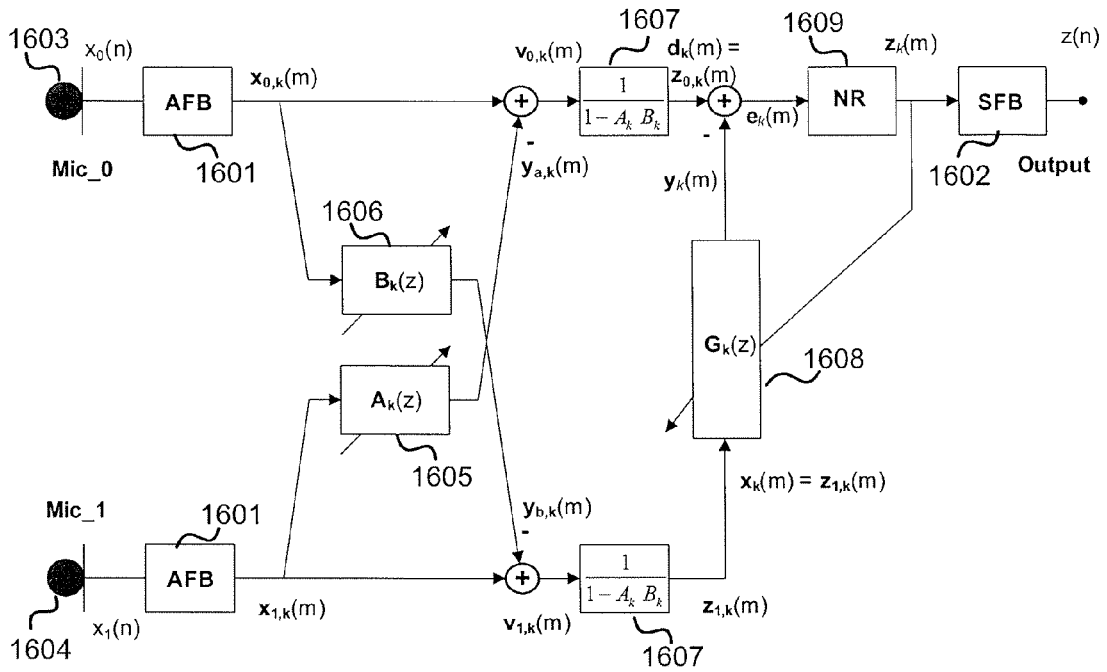
FIG. 16 shows a block diagram of a two-microphone based NR system.

FIG. 16 shows a block diagram of a two-microphone based NR system which includes an ADF algorithm, a post-processing module (e.g., using ANC) and a single-microphone NR algorithm. As shown in FIG. 16, when the elements which are described individually above are combined with other frequency-domain modules, the AFB 1601 (e.g., DFT analysis) and SFB 1602 are applied at the front and the back of all modules, respectively. Whilst the subband signals could be recombined and then decomposed between modules, this may increase the delay and required computation of the system.

Figure 17:
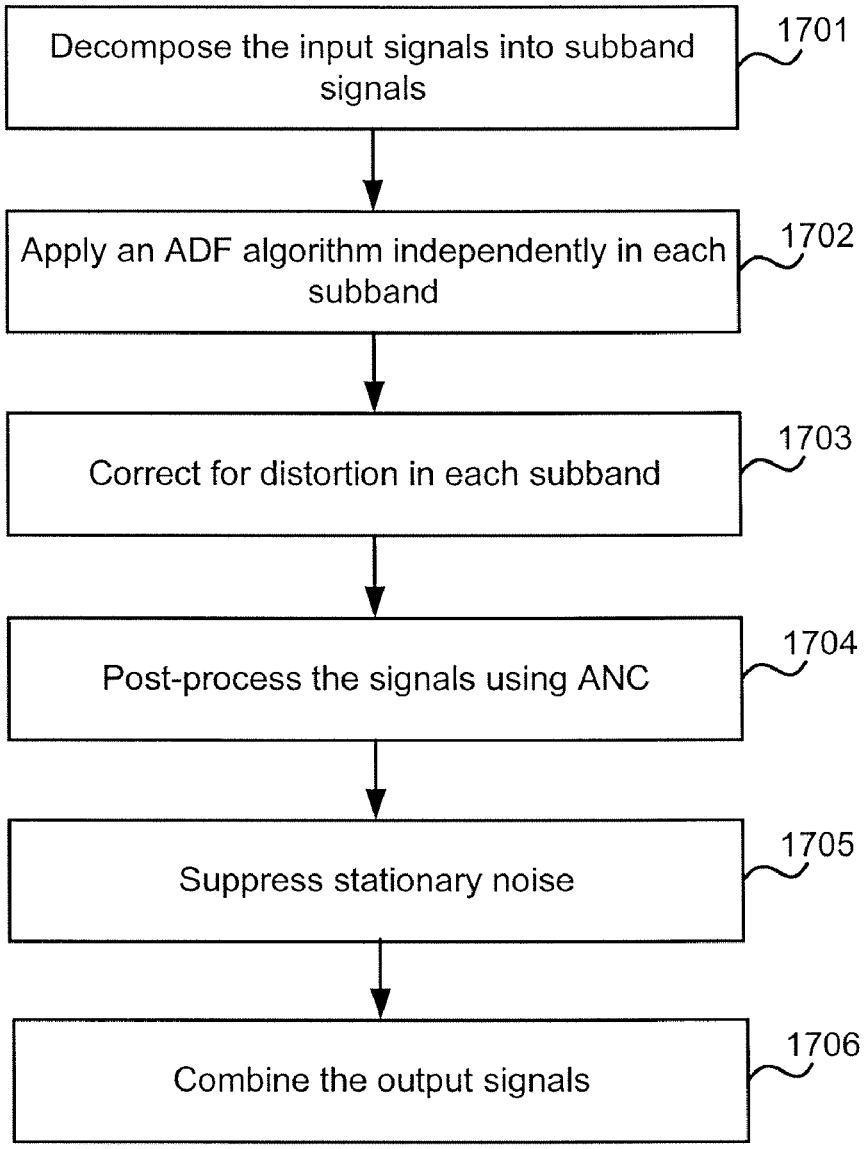
FIG. 17 shows a flow diagram of an exemplary method of operation of the system of FIG. 16.

The operation of the system is shown in the flow diagram of FIG. 17. The system detects signals $x_0(n)$, $x_1(n)$ using two microphones 1603, 1604 (Mic_0 and Mic_1) and these signals are decomposed (block 1701) using AFBs 1601. An ADF algorithm is then independently applied to each subband (block 1702) using filters $A_k(Z)$ and $B_k(z)$ 1605, 1606. The subband outputs from the ADF algorithm are corrected for distortion (block 1703) using filters 1607 and the outputs from these filters are input to the post-processing module (block 1704) comprising filter $G_k(Z)$ 1608 which uses an ANC algorithm. The stationary noise is then suppressed (block 1705) using a single-microphone NR algorithm 1609 and the output subband signals are then combined (block 1706) to create a fullband output signal z(n). The individual method blocks shown in FIG. 17 are described in more detail above.

In an example of FIG. 16, the ADF algorithm performs signal separation and the ADF and ANC algorithms both suppress stationary and non-stationary noise. The NR algorithm provides optimal stationary noise suppression.

The system shown in FIG. 16 provides powerful and robust NR performance for stationary and non-stationary noises, with moderate computational complexity. The system also has fewer microphones than the number of signal sources, i.e., to obtain the separation of the headset/handset user from all the other simultaneous interferences, two microphones are used instead of one microphone for each competing source.

An examplary application for the system shown in FIG. 16, or any other of the systems and methods described herein, is where the two microphones are separated by approximately 2-4 cm, for example in a mobile telephone or a headset (e.g., a Bluetooth® headset). The algorithms may, for example, be implemented in a chip which has Bluetooth® and DSP capabilities or in a DSP chip without the Bluetooth® capability. In such an example, the input signals, as received by the two microphones, may be distinct mixtures of a desired user speech and other undesired noise and the fullband output signal comprises the desired user speech. The first microphone (e.g., Mic_0 1603 in FIG. 16) may be placed closer to the mouth of the user than the second microphone (e.g., Mic_1 1604).

Although the examples described above show two microphones, the systems and methods described herein may be extended to situations where there are more than two microphones.

Those skilled in the art will realize that storage devices utilized to store program instructions can be distributed across a network. For example, a remote computer may store an example of the process described as software. A local or terminal computer may access the remote computer and download a part or all of the software to run the program. Alternatively, the local computer may download pieces of the software as needed, or execute some software instructions at the local terminal and some at the remote computer (or computer network). Those skilled in the art will also realize that by utilizing conventional techniques known to those skilled in the art that all, or a portion of the software instructions may be carried out by a dedicated circuit, such as a DSP, programmable logic array, or the like.

Any range or device value given herein may be extended or altered without losing the effect sought, as will be apparent to the skilled person.

It will be understood that the benefits and advantages described above may relate to one embodiment or may relate to several embodiments. The embodiments are not limited to those that solve any or all of the stated problems or those that have any or all of the stated benefits and advantages.

Any reference to 'an' item refers to one or more of those items. The term 'comprising' is used herein includes the method blocks or elements identified, but such blocks or elements do not comprise an exclusive list; a method or apparatus may contain additional blocks or elements.

The steps of the methods described herein may be carried out in any suitable order, or simultaneously where appropriate. Additionally, individual blocks may be deleted from any of the methods without departing from the spirit and scope of the subject matter described herein. Aspects of any of the examples described above may be combined with aspects of any of the other examples described to form further examples without losing the effect sought.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A method of noise reduction comprising:

using analysis filter banks to decompose each of a first and a second input signal into a plurality of subbands, the first and second input signals being received by two closely spaced microphones;

applying an adaptive decorrelation filter in each subband for each of the first and second signals to generate a plurality of filtered subband signals from each of the first and second input signals;

adapting the filter in each subband for each of the input signals based on a step-size function associated with the subband and the input signal, wherein a direction of the step-size function associated with a subband and one of the first and second input signals is adjusted according to a phase of a cross-correlation between an input subband signal from the other of the first and second input signals and a filtered subband signal from said other of the first and second input signals; and using a synthesis filter bank to combine said plurality of filtered subband signals from the first input signal to generate a restored fullband signal.

2. A method according to claim 1, wherein the step-size function associated with a subband and an input signal is normalized against a total power in the subband for both the first and second input signals.

3. A method according to claim 1, wherein the step-size function associated with a subband and an input signal is adjusted based on a ratio of a power level of the filtered subband signal from said subband input signal to a power level of said subband input signal.

4. A method according to claim 1, further comprising, prior to using a synthesis filter bank to combine said plurality of filtered subband signals from the first input signal:

applying an adaptive noise cancelation filter to the filtered subband signals independently in each subband.

5. A method according to claim 4, wherein applying an adaptive noise cancelation filter to the filtered subband signals independently in each subband comprises:

applying an adaptive noise cancelation filter independently to a first and a second filtered subband signal in each subband; and adapting each said adaptive noise cancelation filter in each subband based on a step-size function associated with the separated subband signal.

6. A method according to claim 5, further comprising, for each filtered subband signal:

if a subband is in a defined frequency range, setting the associated step-size function to zero if power in the filtered subband signal output from the adaptive noise cancelation filter exceeds a noise reference power in the subband; and if a subband is not in the defined frequency range, setting the associated step-size function to zero based on a determination of a number of subbands in the defined frequency range having an associated step-size set to zero.

7. A method according to claim 1, further comprising, prior to using a synthesis filter bank to combine said plurality of filtered subband signals from the first input signal:

applying an adaptive noise cancelation filter to the filtered subband signals generated by the adaptive decorrelation filter independently in each subband to generate a plurality of error subband signals from the first input signal; and applying a single-microphone noise reduction algorithm to the error subband signals to generate the plurality of filtered subband signals from the first input signal for input to the synthesis filter bank.

8. A noise reduction system comprising:

an first input from a first microphone;

a second input from a second microphone closely spaced from the first microphone;

an analysis filter bank coupled to the first input and arranged to decompose a first input signal into subbands;

an analysis filter bank coupled to the second input and arranged to decompose a second input signal into subbands;

at least one adaptive filter element arranged to be applied independently in each subband, the at least one adaptive filter element comprising an adaptive decorrelation filter element and wherein the adaptive decorrelation filter element is further arranged to control a direction of adaptation of the filter element for each subband for a first input based on a phase of a cross correlation of a second input subband signal and a second subband signal output from the adaptive decorrelation filter element; and a synthesis filter bank arranged to combine a plurality of restored subband signals output from the at least one adaptive filter element.

9. A noise reduction system according to claim 8, wherein the adaptive decorrelation filter element is arranged to control adaptation of the filter element for each subband based on power levels of a first input subband signal and a second input subband signal.

10. A noise reduction system according to claim 8, wherein the adaptive decorrelation filter element is further arranged to control adaptation of the filter element for each subband for the first input based on a ratio of a power level of a first subband signal output from the adaptive decorrelation filter element to a power level of a first subband input signal.

11. A noise reduction system according to claim 8, wherein the at least one adaptive filter element further comprises an adaptive noise cancelation filter element.

12. A noise reduction system according to claim 11, wherein the adaptive noise cancelation filter element is arranged to:

stop adaptation of the adaptive noise cancelation filter element for subbands in a defined frequency range where the subband power input to the adaptive noise cancelation filter element exceeds the subband power output from the adaptive noise cancelation filter element; and to stop adaptation of the adaptive noise cancelation filter element for subbands not in the defined frequency range based on an assessment of adaptation rates in subbands in the defined frequency range.

13. A noise reduction system according to claim 11, wherein the at least one adaptive filter element further comprises a single-microphone noise reduction element.

14. A method of noise reduction comprising:

receiving a first signal from a first microphone;

receiving a second signal from a second microphone;

decomposing, in analysis filter banks the first and second signals into a plurality of subbands;

for each subband, applying an adaptive decorrelation filter independently to generate a plurality of filtered subband signals from the first input signal; and combining said plurality of filtered subband signals using a synthesis filter bank to generate a restored fullband signal, wherein applying an adaptive decorrelation filter independently comprises, for each adaptation step m:

computing samples of separated signals $v_{0,k}(m)$ and $v_{1,k}(m)$ corresponding to the first and second signals in a subband k based on estimates of filters of length M with coefficients $\bar{a}_k$ and $\bar{b}_k$ using:

$$v_{0,k}(m)=x_{0,k}(m)-\bar{x}_{1,k}(m)^T\bar{a}_k^{(m-1)}$$

$$v_{1,k}(m)=x_{1,k}(m)-\bar{x}_{0,k}(m)^T\bar{b}_k^{(m-1)}$$

where:

$$\bar{x}_{0,k}(m)=[x_{0,k}(m)x_{0,k}(m-1)\Lambda x_{0,k}(m-M+1)]^T$$

$$\bar{x}_{1,k}(m)=[x_{1,k}(m)x_{1,k}(m-1)\Lambda x_{1,k}(m-M+1)]^T$$

$$\bar{a}_k=[a_k(0)a_k(1)\Lambda a_k(M-1)]^T$$

$$\bar{b}_k=[b_k(0)b_k(1)\Lambda b_k(M-1)]^T$$

and;

updating the filter coefficients, using:

$$\bar{a}_k^{(m)}=\bar{a}_k^{(m-1)}+\mu_{a,k}(m)\bar{v}_{1,k}^*(m)v_{0,k}(m)$$

$$\bar{b}_k^{(m)}=\bar{b}_k^{(m-1)}+\mu_{b,k}(m)\bar{v}_{0,k}^*(m)v_{1,k}(m)$$

where * denotes a complex conjugate, $\mu_{a,k}(m)$ and $\mu_{b,k}(m)$ are subband step-size functions and where:

$$\bar{v}_{0,k}(m)[v_{0,k}(m)v_{0,k}(m-1)\Lambda v_{0,k}(m-M+1)]^T$$

$$\bar{v}_{1,k}(m)[v_{1,k}(m)v_{1,k}(m-1)\Lambda v_{1,k}(m-M+1)]^T$$

and wherein the subband step-size functions are given by:

$$\mu_{a,k} = \frac{2\gamma\exp(-j\angle\sigma_{x1v1,k})}{M(\sigma_{x0,k}^2 + \sigma_{x1,k}^2)} \times \max\left(1 - \frac{\sigma_{\hat{s}0,k}^2}{\sigma_{x0,k}^2}, 0\right)$$

and:

$$\mu_{b,k} = \frac{2\gamma\exp(-j\angle\sigma_{x0v0,k})}{M(\sigma_{x0,k}^2 + \sigma_{x1,k}^2)} \times \max\left(1 - \frac{\sigma_{\hat{s}1,k}^2}{\sigma_{x1,k}^2}, 0\right)$$

where:

$$\sigma_{\hat{s}0,k}^2 = E\{|\hat{s}_{0,k}(m)|^2\}$$

$$\sigma_{\hat{s}1,k}^2 = E\{|\hat{s}_{1,k}(m)|^2\}.$$

$$\sigma_{x0,k}^2 = E\{|x_{0,k}(m)|^2\}$$

-continued $$\sigma_{x1,k} = E\{|x_{1,k}(m)|^2\}$$

$$\sigma_{x0v0,k} = E\{x_{0,k}(m)v_{0,k}^*(m)\}$$

$$\sigma_{x1v1,k} = E\{x_{1,k}(m)v_{1,k}^*(m)\}; \text{ and}$$

where $\hat{s}_{0,k}(m)$ and $\hat{s}_{1,k}(m)$ comprise restored subband signals.

15. A method of noise reduction according to claim 14, further comprising, prior to combining said plurality of filtered subband signals:

for each subband, applying an adaptive noise cancelation filter independently to the filtered subband signals output from the adaptive decorrelation filter.

* * * * *

UNITED STATES PATENT AND TRADEMARK OFFICE

CERTIFICATE OF CORRECTION

PATENT NO. : 8,131,541 B2
APPLICATION NO. : 12/110182
DATED : March 6, 2012
INVENTOR(S) : Yen et al.

It is certified that error appears in the above-identified patent and that said Letters Patent is hereby corrected as shown below:

On the Cover Page, item (56), under "OTHER PUBLICATIONS", in Column 2, Line 8, delete "Janury" and insert -- January --, therefor.

In Column 4, Line 38, delete "$\bar{v}_{0,k}(m)$" and insert -- $\bar{v}_{0,k}(m) =$ --, therefor.

In Column 4, Line 40, delete "$\bar{v}_{1,k}(m)$" and insert -- $\bar{v}_{1,k}(m) =$ --, therefor.

In Column 7, Line 23, delete "$A_k(Z)$" and insert -- $A_k(z)$ --, therefor.

In Column 7, Line 41, delete "$[a_k(0)a_k(1)a_k(M-1)]^T$" and insert -- $[a_k(0) \quad a_k(1) \quad \cdots \quad a_k(M-1)]^T$ --, therefor.

In Column 7, Line 44, delete "$[b_k(0)b_k(1)b_k(M-1)]^T$" and insert -- $[b_k(0) \quad b_k(1) \quad \cdots \quad b_k(M-1)]^T$ --, therefor.

In Column 8, Line 6, delete "$=\bar{a}_k^{(m-1)}+\mu_{0,k}(m)\bar{v}_{1,k}^*(m)v_{0,k}(m)$" and insert -- $= \bar{a}_k^{(m-1)} + \mu_{a,k}(m)\,\bar{v}_{1,k}^*(m)\,v_{0,k}(m)$ --, therefor.

In Column 9, Line 56, delete "$A_k(Z)$:" and insert -- $A_k(z)$: --, therefor.

Signed and Sealed this
Tenth Day of July, 2012

David J. Kappos

David J. Kappos
*Director of the United States Patent and Trademark Office*

In Column 10, Line 19, in Equation (15), delete "$\frac{2\gamma\exp(-j\angle\sigma_{x1v1,k})}{M(\sigma_{x0,k}^2+\sigma_{x1,k}^2)}$" and insert -- $\frac{2\gamma\exp(-j\angle\hat{\sigma}_{x1v1,k})}{M(\hat{\sigma}_{x0,k}^2+\hat{\sigma}_{x1,k}^2)}$ --, therefor.

In Column 10, Line 22, delete "$A_k(Z)$" and insert -- $A_k(z)$ --, therefor.

In Column 10, Line 24, delete "$B_k(Z)$" and insert -- $B_k(z)$ --, therefor.

In Column 10, Line 37, delete "$\cos(\angle_{x1v1,k})$" and insert -- $\cos(\angle\hat{\sigma}_{x1v1,k})$ --, therefor.

In Column 12, Line 3, delete "$\sigma_{a,k}$" and insert -- $\mu_{a,k}$ --, therefor.

In Column 11, Line 7, delete "$A_k(Z)$," and insert -- $A_k(z)$, --, therefor.

In Column 13, Line 55, delete "examplary" and insert -- exemplary --, therefor.

In Column 14, Line 23, in Equation (32), delete "y(m)" and insert -- $y_k(m)$ --, therefor.

In Column 14, Line 50, delete "$\hat{\sigma}_{e,k}$" and insert -- $\hat{\sigma}_{e,k}^2$ --, therefor.

In Column 15, Line 1, delete "$(k\in\Omega_{SP})$" and insert -- $(k\notin\Omega_{SP})$ --, therefor.

In Column 15, Line 6, delete "$k\in\Omega_{SP})$" and insert -- $k\notin\Omega_{SP})$ --, therefor.

In Column 15, Line 37, delete "$k\in\Omega_{SP}:$" and insert -- $k\notin\Omega_{SP}:$ --, therefor.

In Column 15, Line 49, delete "$\hat{\sigma}_{x,k}(m).$" and insert -- $\hat{\sigma}_{x,k}^2(m).$ --, therefor.

In Column 16, Line 27, delete "$G_{NR,k}(M)$" and insert -- $G_{NR,k}(m)$ --, therefor.

In Column 16, Line 35, delete "examplary" and insert -- exemplary --, therefor.

In Column 17, Line 20, delete "$A_k(Z)$" and insert -- $A_k(z)$ --, therefor.

In Column 17, Line 24, delete "$G_k(Z)$" and insert -- $G_k(z)$ --, therefor.

In Column 17, Line 42, delete "examplary" and insert -- exemplary --, therefor.

In Column 20, Line 48, delete "Λ" and insert -- ... --.

In Column 20, Line 50, delete "Λ" and insert -- ... --.

In Column 20, Line 52, delete "Λ" and insert -- ... --.

In Column 20, Line 54, delete "Λ" and insert -- ... --.

In Column 20, Line 54, in Claim 14, delete "$\Lambda b_k(M-1)]^T$" and insert -- $\Lambda \quad b_k(N-1)]^T$ --, therefor.

In Column 20, Line 65, in Claim 14, delete "$\bar{v}_{0,k}(m)$" and insert -- $\bar{v}_{0,k}(m) \quad =$ --, therefor.

In Column 20, Line 65, delete "Λ" and insert -- ... --.

In Column 20, Line 67, delete "Λ" and insert -- ... --.

In Column 20, Line 67, in Claim 14, delete "$\bar{v}_{1,k}(m)$" and insert -- $\bar{v}_{1,k}(m) \quad =$ --, therefor.

In Column 22, Line 1, in Claim 14, delete "$\sigma_{x1,k}$" and insert -- $\sigma^2_{x1,k}$ --, therefor.